US007410328B2

(12) United States Patent
Hamel

(10) Patent No.: US 7,410,328 B2
(45) Date of Patent: Aug. 12, 2008

(54) CONCRETE BLOCK SYSTEM

(75) Inventor: Denis Hamel, Baie d'Urfé (CA)

(73) Assignee: Transpavé Inc., St-Eustache, Quebec (CA)

( * ) Notice: Subject to any disclaimer, the term of this patent is extended or adjusted under 35 U.S.C. 154(b) by 0 days.

(21) Appl. No.: 11/452,520

(22) Filed: Jun. 14, 2006

(65) Prior Publication Data

US 2007/0292216 A1 Dec. 20, 2007

(51) Int. Cl.
*E02D 29/02* (2006.01)

(52) U.S. Cl. ..... 405/286; 405/284; 405/262

(58) Field of Classification Search ..... 405/286, 405/284, 262

See application file for complete search history.

(56) References Cited

U.S. PATENT DOCUMENTS

| | | | | | |
|---|---|---|---|---|---|
| 4,896,999 | A | * | 1/1990 | Ruckstuhl | 405/286 |
| 5,282,700 | A | * | 2/1994 | Rodrique | 405/286 |
| 5,350,256 | A | * | 9/1994 | Hammer | 405/286 |
| 5,474,405 | A | * | 12/1995 | Anderson et al. | 405/286 |
| 5,528,873 | A | * | 6/1996 | Correia et al. | 405/286 |
| 5,688,078 | A | * | 11/1997 | Hammer | 405/286 |
| 5,707,184 | A | * | 1/1998 | Anderson et al. | 405/286 |
| 5,788,423 | A | * | 8/1998 | Perkins | 405/286 |
| 5,820,304 | A | * | 10/1998 | Sorheim et al. | 405/286 |
| 6,062,772 | A | * | 5/2000 | Perkins | 405/286 |

OTHER PUBLICATIONS

Lock + Load, Retaining Walls, www.lock-load.com, 2 pages.

Recon, Retaining Wall Systems, The ReCon Wall System. . . , ReCon Wall System, Inc., www.reconwalls.com, 4 pages.

Idea Book, Courtyard Collection, Create The Classic Look of Stone Walls, Allan Block, allanblock.com, 2005 Allan Block Corporation, 12 pages.

Keystone, Retaining Wall Systems, Retaining Excellence, Imagine the Possibilities, Keystone Retaining Walls Systems, Inc., 2004, www.keystonewalls.com, 20 pages.

Redi-Rock International LLC, What's The Big Idea?, More Redi-Rock Solutioins, www.redi-rock.com, 4 pages.

Sound., Not what you'd expect from the typical strong, silent type., The first and only fully enginneered precast block, Stone Strong Systems, www.stonestrong.com, 2 pages.

WestBlockSystems, GravityStone, http://nurserystone.com/index.html, Jun. 13, 2006, 3 pages.

* cited by examiner

*Primary Examiner*—Frederick L Lagman

(57) ABSTRACT

A dry-cast concrete block system for use in a structure. The dry-cast concrete block system comprises a support block comprising a first coupling part and a face block comprising a second coupling part. The first coupling part and the second coupling part enable the face block to be coupled to the support block. The face block comprises a surface adapted to be exposed when the face block is coupled to the support block and the dry-cast concrete block system is positioned in the structure. In one embodiment, at least a portion of the surface has a cast texture with a natural stone appearance. In one embodiment, the structure is a wall and the concrete block system is a wall block system. For example, the wall may be a retaining wall and the wall block system may be a retaining wall block system. In another embodiment, the structure is a column and the concrete block system is a column block system. In yet another embodiment, the structure is steps and the concrete block system is a steps block system.

35 Claims, 22 Drawing Sheets

CONCRETE BLOCK SYSTEM

FIELD OF THE INVENTION

The present invention relates to concrete blocks, in particular those with a natural stone appearance, that may be used in walls, columns, steps and other types of structures.

BACKGROUND

Concrete blocks intended to serve as wall blocks (e.g., retaining wall blocks), column blocks, step blocks or other types of structural blocks are sometimes provided with a natural stone appearance over an exposed portion thereof. Such concrete blocks can then be assembled into walls, columns, steps or other structures that have a natural and aesthetic look.

While various configurations, sizes and looks exist, these concrete blocks are conventionally monolithic elements made of various types of concrete. This monolithic character often detrimentally affects versatility of existing concrete blocks and their capability to accommodate design constraints of structures to be constructed.

Also, depending on their constituent concrete, concrete blocks can be broadly divided into dry-cast concrete blocks and wet-cast concrete blocks. Different processes are used to manufacture these two types of concrete blocks and, in particular, to provide them with a natural stone appearance.

Wet-cast concrete blocks may have a natural stone appearance realized directly during casting, but relatively long production times and requirements for numerous molds typically render impractical their efficient mass-production. For their part, dry-cast concrete blocks normally have relatively short production times and require only one or a few molds, which facilitates their mass-production. However, these relatively short production times impose constraints on a degree of surface irregularity that may be imparted to dry-cast concrete blocks during casting, thereby preventing realization of a natural stone appearance during casting. Dry-cast concrete blocks are thus typically subjected after casting to a mechanical artificial aging/weathering process (e.g., tumbling, splitting/breaking, object impacting, etc.) to realize desired natural stone characteristics, which decreases production efficiency.

There is therefore a need for improvements in concrete blocks, in particular those with a natural stone appearance, that may be used in walls, columns, steps and other types of structures.

SUMMARY OF THE INVENTION

As embodied and broadly described herein, the invention provides a dry-cast concrete block system for use in a structure. The dry-cast concrete block system comprises a support block comprising a first coupling part and a face block comprising a second coupling part. The first coupling part and the second coupling part enable the face block to be coupled to the support block. The face block comprises a surface adapted to be exposed when the face block is coupled to the support block and the dry-cast concrete block system is positioned in the structure.

In one embodiment, at least a portion of the surface has a cast texture with a natural stone appearance.

In one embodiment, the structure is a wall and the concrete block system is a wall block system. For example, the wall may be a retaining wall and the wall block system may be a retaining wall block system.

In one embodiment, the structure is a column and the concrete block system is a column block system. In another embodiment, the structure is steps and the concrete block system is a steps block system.

As embodied and broadly described herein, the invention provides a dry-cast concrete block system for use in a retaining wall. The dry-cast concrete block system comprises a support block comprising a first coupling part, the support block being adapted to be embedded in material to be retained by the retaining wall. The dry-cast concrete block system also comprises a face block comprising a second coupling part. The first coupling part and the second coupling part enable the face block to be coupled to the support block. The face block comprises a surface adapted to be exposed when the face block is coupled to the support block and the dry-cast concrete block system is positioned in the retaining wall.

These and other aspects and features of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
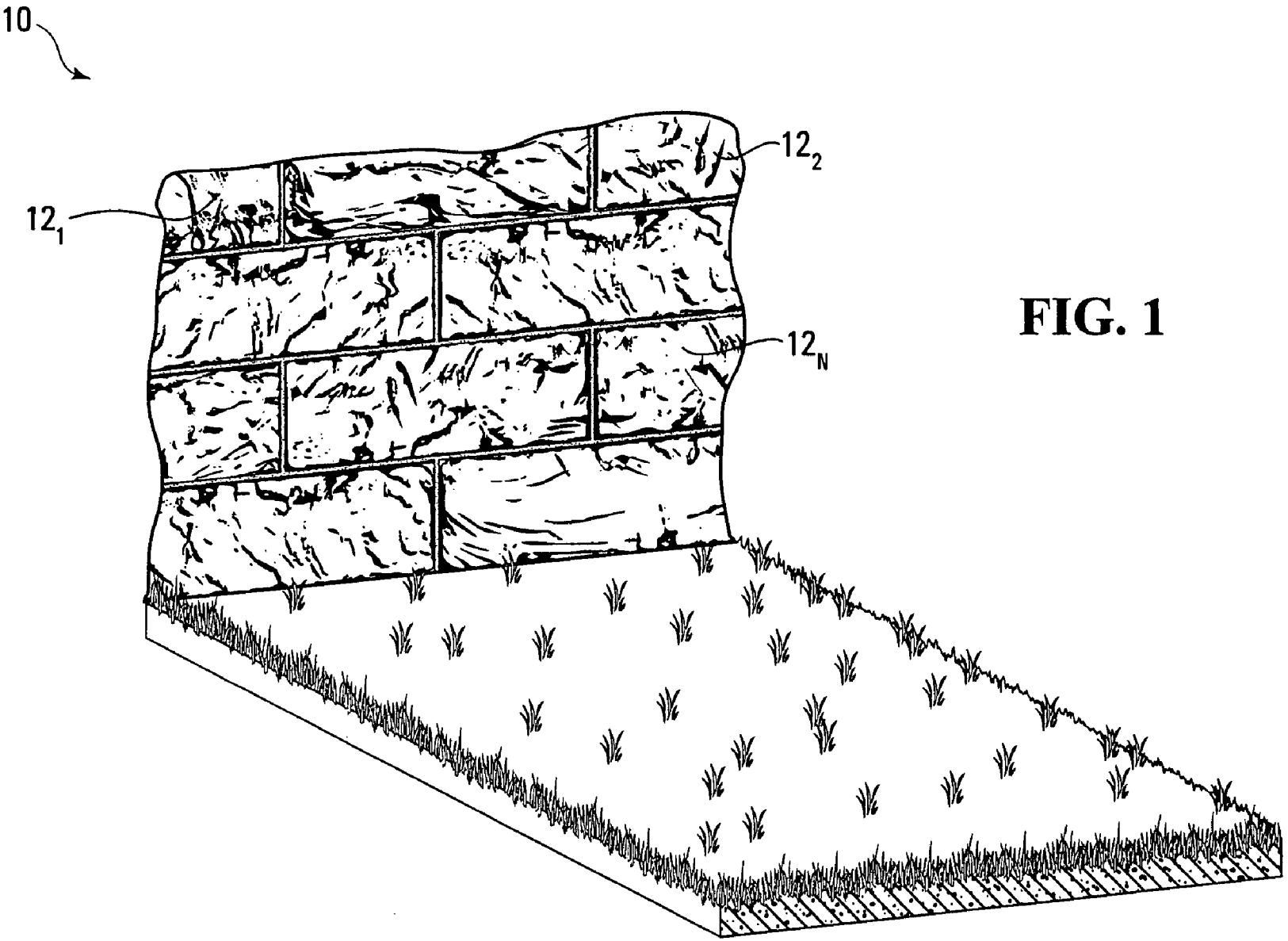
FIG. 1 shows a wall portion comprising a plurality of concrete block systems in accordance with an embodiment of the invention.
Figure 2:
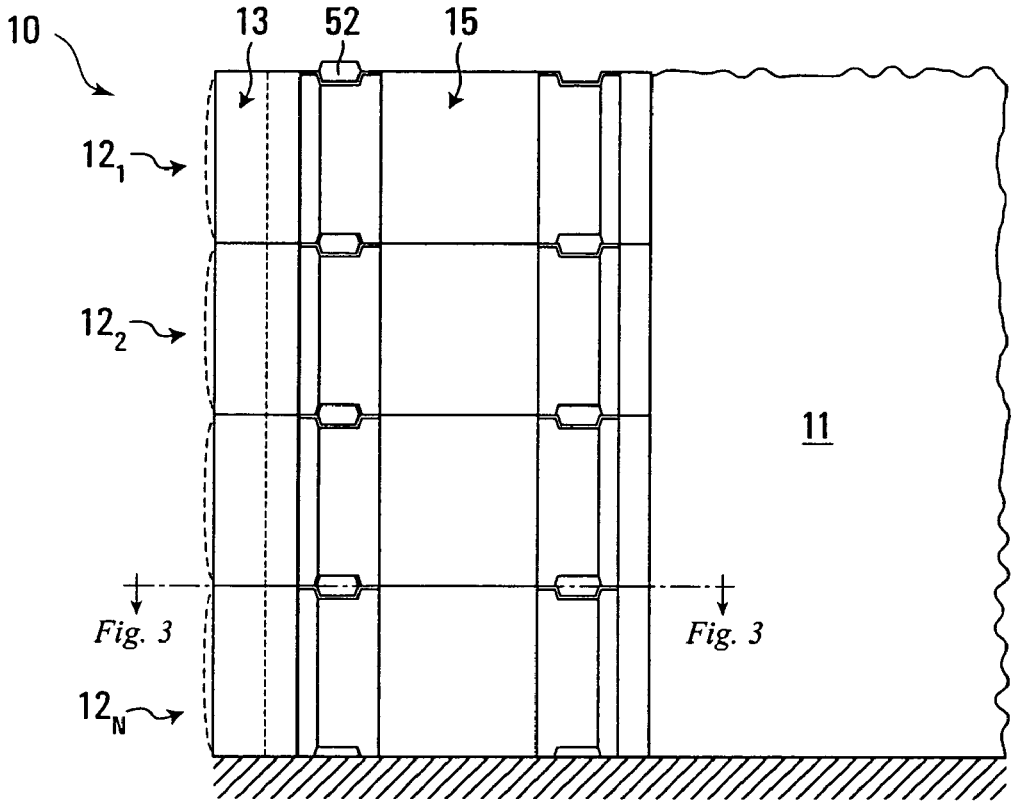
FIG. 2 shows a side view of part of the wall portion shown in FIG. 1.
Figure 3:
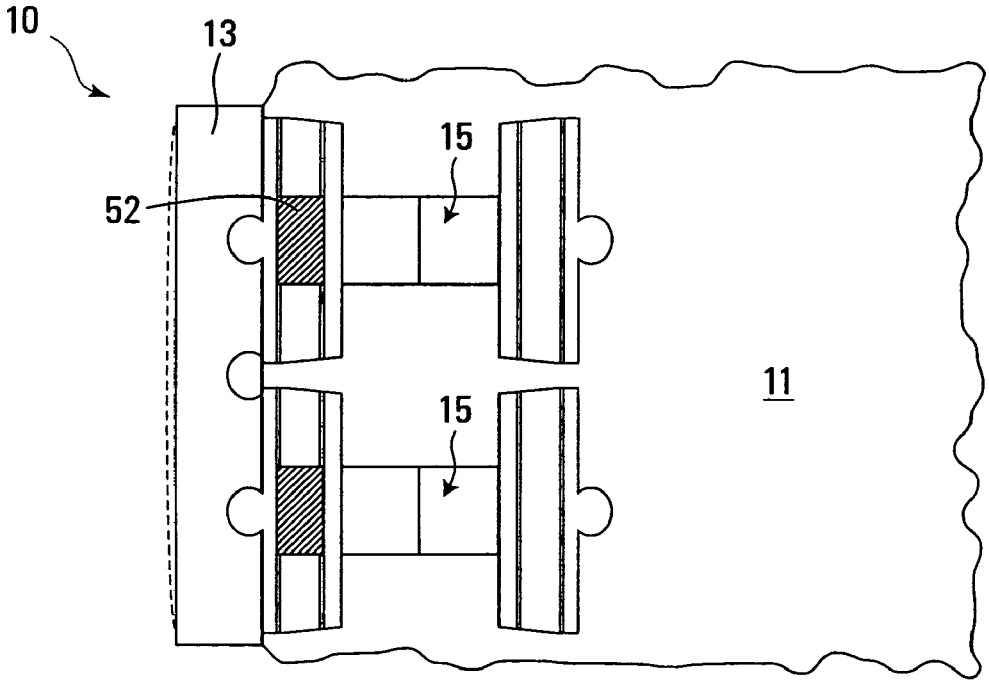
FIG. 3 shows a cross-sectional view of part of the wall portion shown in FIG. 2.

FIGS. 1 to 3 show a wall portion 10 comprising a plurality of concrete block systems $\mathbf{12}_1 \ldots \mathbf{12}_N$ in accordance with an embodiment of the invention. In this embodiment, the wall portion 10 is part of a retaining wall that holds back material 11 such as soil, drainage aggregate, etc. The concrete block systems $\mathbf{12}_1 \ldots \mathbf{12}_N$ can thus be referred to as retaining wall block systems.

Figure 4:
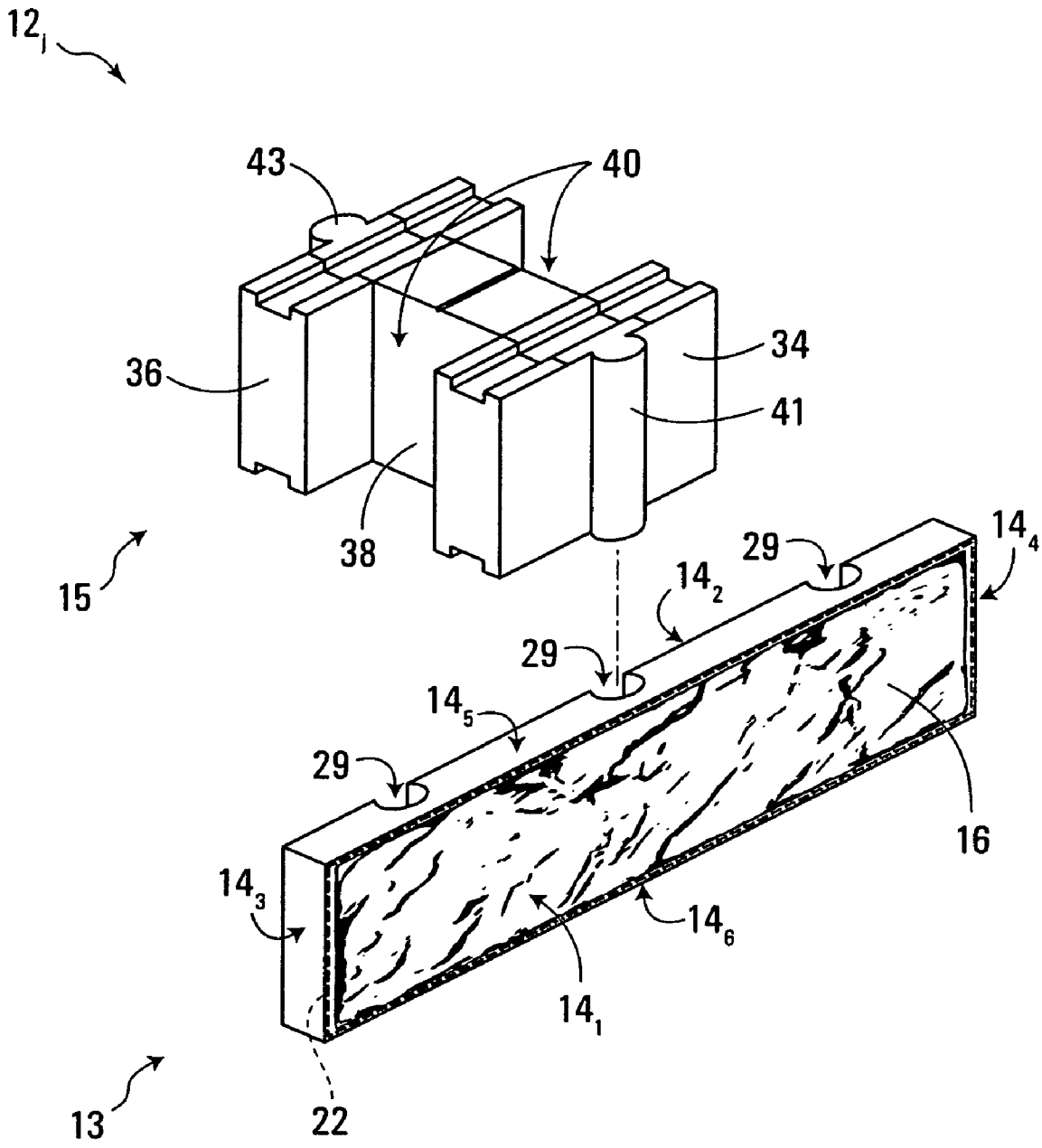
FIG. 4 shows a perspective view of a given concrete block system of the wall portion shown in FIG. 1, comprising a face block and a support block.

With additional reference to FIG. 4, there is shown a given concrete block system 12; of the concrete block systems $\mathbf{12}_1 \ldots \mathbf{12}_N$ ($1 \leqq j \leqq N$). In this embodiment, the concrete block system $\mathbf{12}_j$ comprises a face block 13 adapted to be coupled to a support block 15.

The face block 13 is intended to be at least partly exposed when the concrete block system $\mathbf{12}_j$ is positioned in the wall portion 10, i.e., the face block 13 has a surface adapted to be exposed when the face block 13 is coupled to the support block 15. In this embodiment, the face block 13 is a dry-cast concrete block, i.e., it is made of no-slump concrete. No-slump concrete (also known as zero-slump concrete) can be viewed as concrete with a slump of 6 mm or less. It will be appreciated that various types of no-slump concrete are possible and may be used. It will also be appreciated that, in other embodiments, the face block 13 may be made of other types of concrete (e.g., measurable-slump concrete).

In this embodiment, the face block 13 can be said to have a generally rectangular prism configuration with six surfaces $\mathbf{14}_1 \ldots \mathbf{14}_6$. In other embodiments, the face block 13 may have any desired configuration with any desired number of surfaces.

The surface $\mathbf{14}_1$ is intended to be exposed when the concrete block system $\mathbf{12}_j$, including the face block 13, is positioned in the wall portion 10. In this embodiment, at least a portion 16 of the surface $\mathbf{14}_1$ has a cast texture having a natural stone appearance, i.e., an aged, worn, or weathered appearance that resembles natural stone. As described later on, the cast texture of the portion 16 of the surface $\mathbf{14}_1$ is realized during casting of the face block 13 and may be based on a natural stone's surface which has been used to produce a mold for casting the face block 13. For ease of reference, the portion 16 of the surface $\mathbf{14}_1$ and its cast texture with a natural stone appearance will hereinafter be referred to as the "natural stone-like surface portion" 16.

Figure 5:
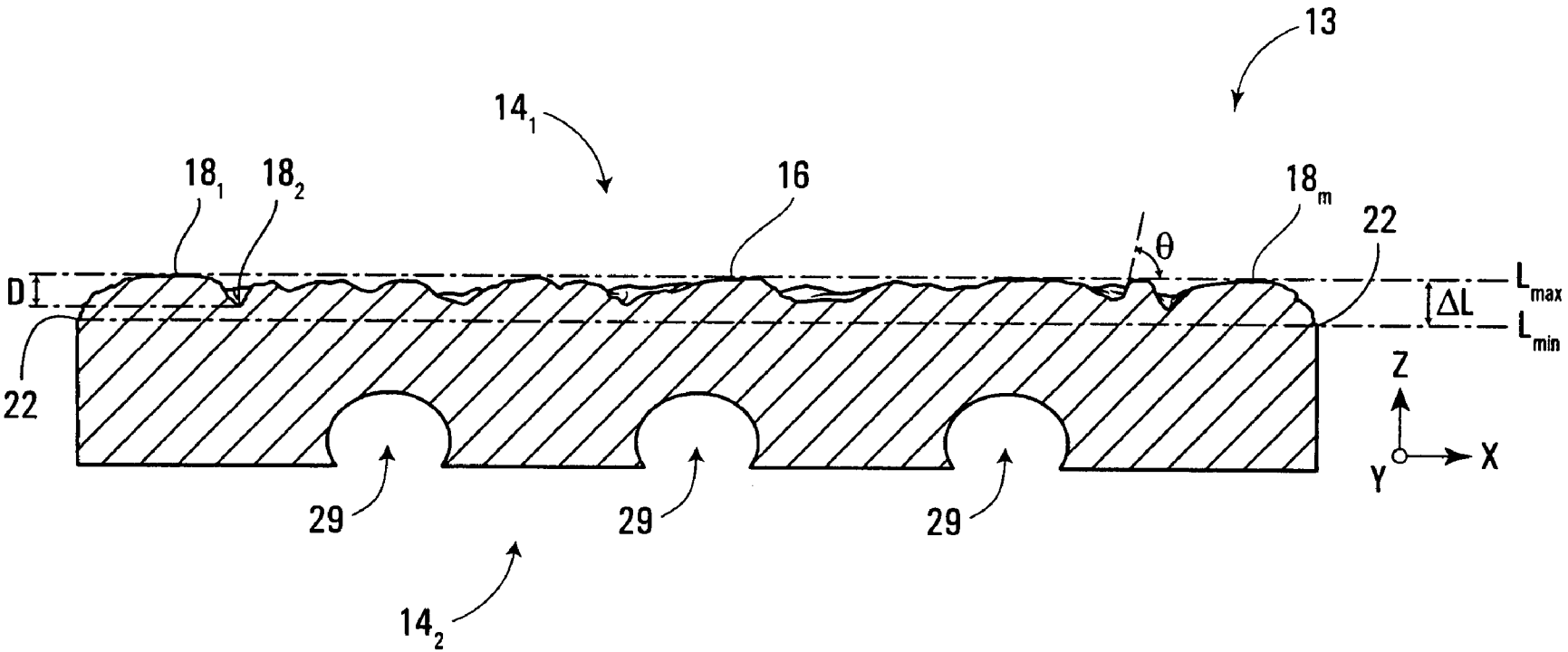
FIG. 5 shows a cross-sectional view of the face block of FIG. 4, illustrating a cast texture of a surface portion of the face block that has a natural stone appearance.
Figure 6:
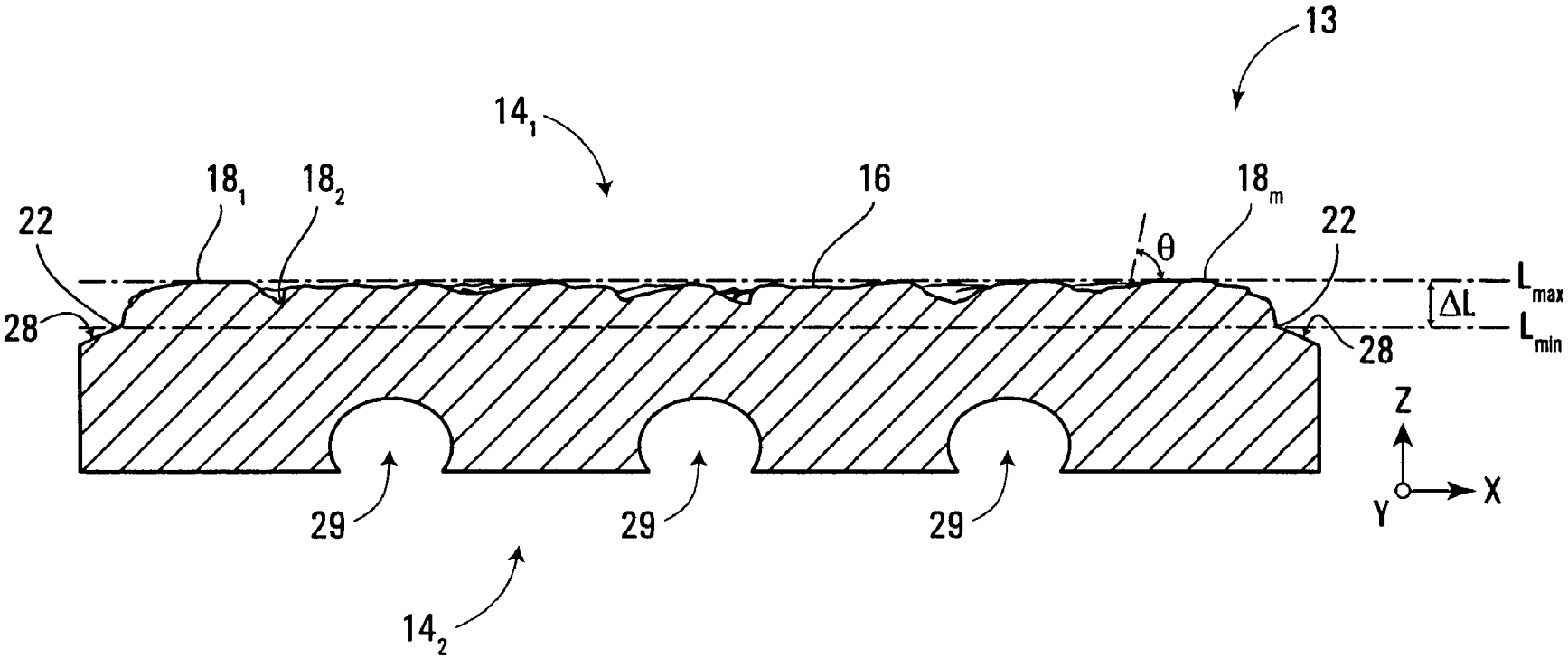
FIG. 6 illustrates a cross-sectional view of an embodiment where a surface portion of a face block that has a natural stone appearance is contiguous to a chamfered, rounded or otherwise non-natural looking edge portion of the face block.
Figure 8A:
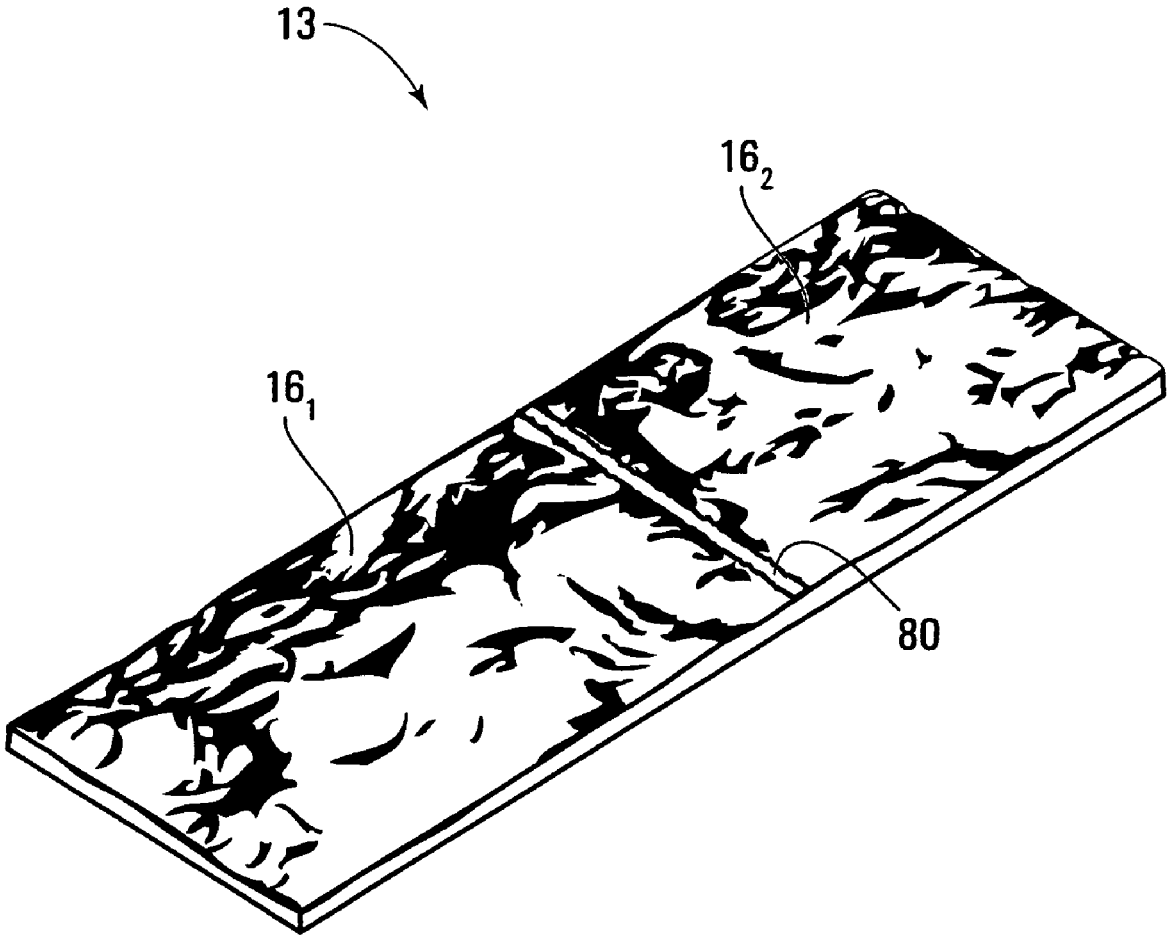
FIGS. 8A and 8B show embodiments in which a face block comprises a plurality of surface portions with a cast texture that has a natural stone appearance.
Figure 8B:
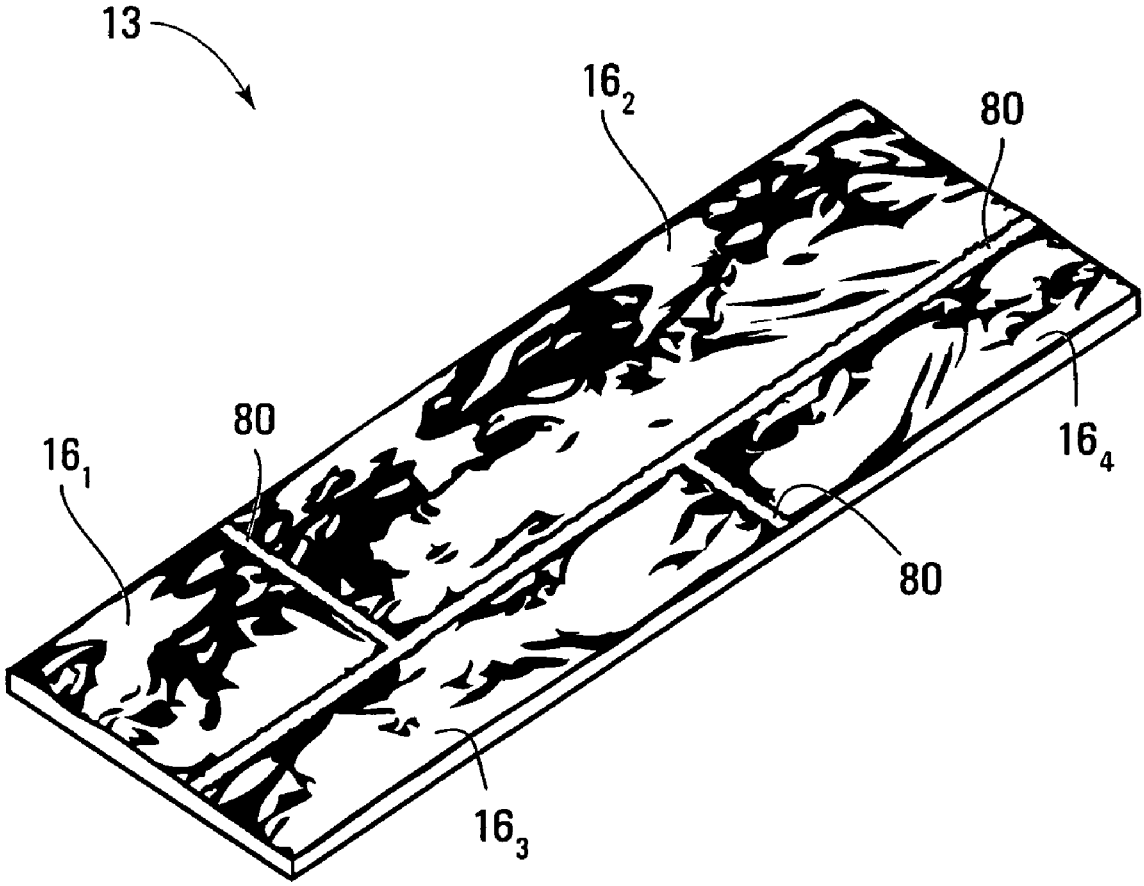

Referring to FIGS. 4 and 5, the natural stone-like surface portion 16 has a visually discernible boundary 22. In this embodiment, the natural stone-like surface portion 16 substantially corresponds to the entire surface $\mathbf{14}_1$ with its boundary 22 substantially corresponding to edges of the surface $\mathbf{14}_1$. In other embodiments, the natural stone-like surface portion 16 may be only a limited portion of the surface $\mathbf{14}_1$ (i.e., not all of that surface). In yet other embodiments, the natural stone-like surface portion 16 may be one of a plurality of natural stone-like surface portions of the surface $\mathbf{14}_1$. For example, FIGS. 8A and 8B show embodiments in which are provided a plurality of natural stone-like surface portions $\mathbf{16}_1 \ldots \mathbf{16}_Q$ separated by a surface portion 80 that does not have a natural stone appearance and can serve as a false joint (where Q=2 in FIG. 8A and Q=4 in FIG. 8B). Generally, any number of natural stone-like surface portions may be provided. Such a plurality of natural stone-like surface portions $\mathbf{16}_1 \ldots \mathbf{16}_Q$ results in a wall portion seeming to include several blocks of various sizes and configurations. Also, as shown in FIG. 6, in embodiments where the natural stone-like surface portion 16 is contiguous to a chamfered, rounded, or otherwise non-natural stone looking edge portion 28 of the face block 13 (e.g., an edge portion serving as a joint), the boundary 22 of the natural stone-like surface portion 16 is considered to be configured such that the chamfered, rounded or otherwise non-natural stone looking edge portion 28 is not part of the natural stone-like surface portion 16.

Continuing with FIGS. 4 and 5, in this embodiment, the natural stone-like surface portion 16 comprises a pattern of cast relief elements $\mathbf{18}_1 \ldots \mathbf{18}_M$ formed during casting of the face block 13. This pattern of cast relief elements $\mathbf{18}_1 \ldots \mathbf{18}_M$ may include a plurality of bumps or peaks and a plurality of valleys or depressions, which are sized so as to be visually distinguishable when the concrete block system $\mathbf{12}_j$, including the face block 13, is positioned in the wall portion 10. It is to be understood that various other patterns of cast relief elements are possible. For example, the natural stone-like surface portions $\mathbf{16}_1 \ldots \mathbf{16}_Q$ in FIGS. 8A and 8B illustrate various other examples of possible patterns of cast relief elements.

The cast texture of the natural stone-like surface portion 16 defines a "surface level difference" $\Delta L$, which refers to the normal distance between a maximum level $L_{max}$ of that surface portion and a minimum level $L_{min}$ of that surface portion. As shown in FIG. 5, the face block 13 can be viewed as defining orthogonal X, Y and Z axes, where the X-Y plane is parallel to a plane that would be formed by the natural stone-like surface portion 16 if that surface portion was flat, i.e., the plane in which lies the boundary 22 of the natural stone-like surface portion 16. A level L at a given point of the natural stone-like surface portion 16 can be viewed as a plane parallel to the X-Y plane, and the surface level difference $\Delta L$ can be viewed as being measured along the Z axis.

Figure 7:
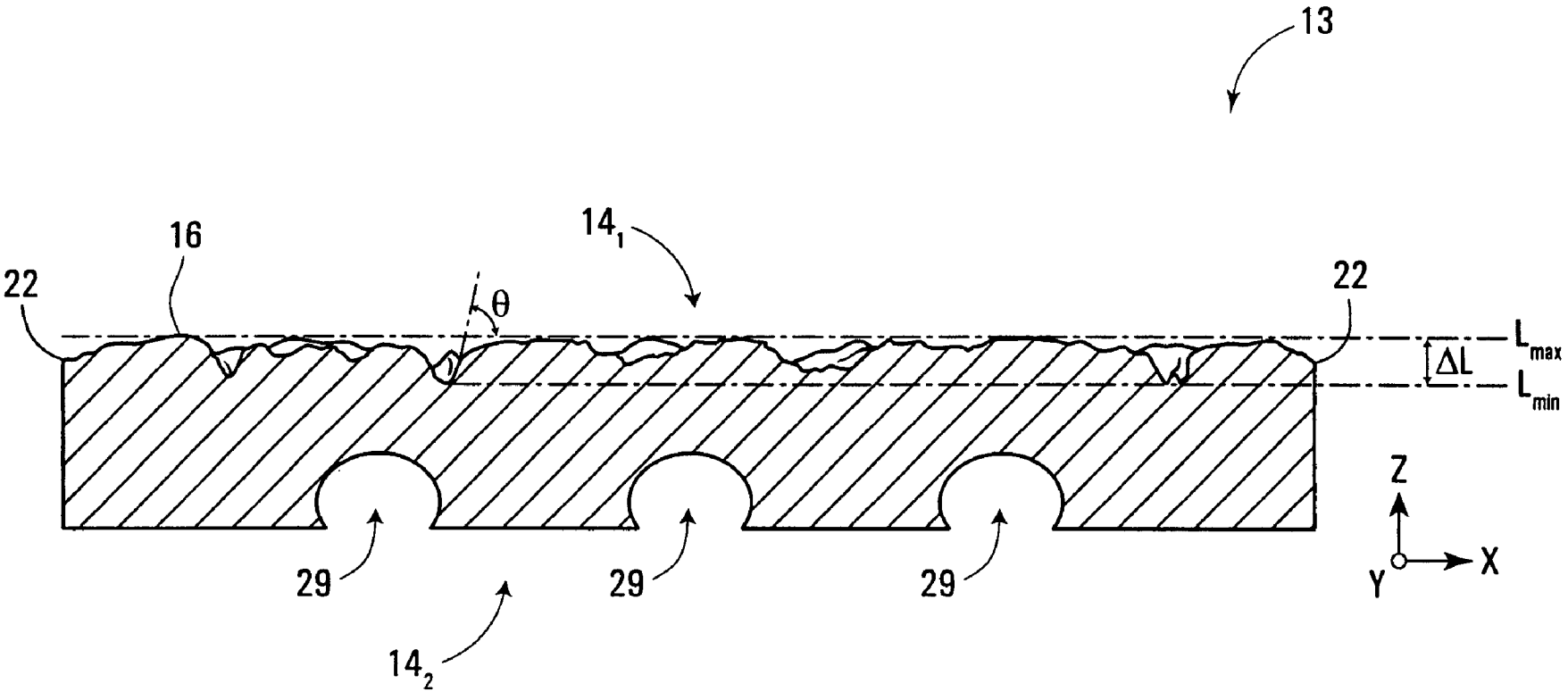
FIG. 7 illustrates a cross-sectional view of an embodiment in which a minimum level of a surface portion of a face block that has a natural stone appearance is not located at a boundary of that surface portion.

In the embodiment shown in FIG. 5, the minimum level $L_{min}$ of the natural stone-like surface portion 16 is located at its boundary 22. Generally, the minimum level $L_{min}$ of the natural stone-like surface portion 16 may be located anywhere on that surface portion. For example, FIG. 7 illustrates an embodiment in which the minimum level $L_{min}$ of the natural stone-like surface portion 16 is not located at its boundary 22. Similarly, the maximum level $L_{max}$ of the natural stone-like surface portion 16 may also be located anywhere on that surface portion, including at its boundary 22.

In one embodiment, the surface level difference $\Delta L$ may greater than 15 mm, for example, between 15 mm and 25 mm. For instance, in a particular case, the surface level difference $\Delta L$ may be about 20 mm. This enables the natural stone-like surface portion 16 to exhibit desired natural stone appearance characteristics. However, it is generally contemplated that a surface level difference $\Delta L$ of greater than 4 mm achieves satisfactory results in terms of natural stone appearance of a surface portion of a face block since it enables presence of visually distinguishable cast texture features mimicking surface texture of natural stone. Also, in embodiments such as those shown in FIGS. 8A and 8B, different ones of the natural stone-like surface portions $16_1 \ldots 16_Q$ may define a common or distinct surface level difference ΔL and may have common or distinct maximum levels $L_{max}$ and minimum levels $L_{min}$.

With continued reference to FIGS. 4 and 5, each of the cast relief elements $18_1 \ldots 18_M$ of the natural stone-like surface portion 16 reaches a respective level L that is the maximum level $L_{max}$, the minimum level $L_{min}$, or a level therebetween. In this embodiment, a plurality of the cast relief elements $18_1 \ldots 18_M$ are seen in FIG. 5 as extending to the maximum level $L_{max}$ of the natural stone-like surface portion 16 and separated from each other by other ones of the cast relief elements $18_1 \ldots 18_M$ that only extend to lower levels. More particularly, the natural stone-like surface portion 16 is configured such that at least three of the cast relief elements $18_1 \ldots 18_M$ extend to the maximum level $L_{max}$ and are positioned relative to each other to provide an effective support on which at least one other face block may be supported. In other words, the maximum level $L_{max}$ of the natural stone-like surface portion 16 provides at least three points that are located relative to each other such that at least one other face block may be supported thereon in a stable manner. This facilitates stacking or palletizing of face blocks for storage or transportation purposes. In embodiments such as those shown in FIGS. 8A and 8B, these at least three points may be distributed among the plurality of natural stone-like surface portions $16_1 \ldots 16_Q$.

Also, in this embodiment, each of the cast relief $18_1 \ldots 18_M$ of the natural stone-like surface portion 16 that is a valley (e.g., the cast relief element $18_2$) can be viewed as having a respective "depth" D, which refers to the normal distance between the maximum level $L_{max}$ of the surface portion 16 and that valley's deepest point. Depending on the surface level difference ΔL, in some embodiments, the respective depth D of each of one or more valleys of the natural stone-like surface portion 16 may be greater than 4 mm, for example, between 4 mm and 10 mm. This may further enhance natural stone appearance characteristics exhibited by the natural stone-like surface portion 16.

Continuing with FIGS. 4 and 5, in this embodiment, the natural stone-like surface portion 16 interacts with ambient light to create shadows that further contribute to its natural stone appearance. More particularly, as shown in FIG. 5, each point of the cast texture of the natural stone-like surface portion 16 defines a respective "texture angle" θ, which refers to the angle between a plane parallel to the X-Y plane and a plane tangent to the natural stone-like surface portion 16 at that point. In one embodiment, the respective texture angle θ of each of a plurality of points of the natural stone-like surface portion 16 may be between about 75° and about 90°. This may contribute to creation of shadows on the natural stone-like surface portion 16 that further enhance its natural stone appearance. Configuring a dry-cast concrete block with a surface level difference ΔL in the above-mentioned ranges has been found to facilitate, if not altogether render possible, formation of such texture angles θ during casting. It is noted, however, that the above-mentioned values of texture angle θ are presented for example purposes only and are not to be considered limiting in any respect.

In the embodiment of FIGS. 4 and 5, it is recalled that the face block 13 is adapted to be coupled to the support block 15. This is achieved by providing the face block 13 with a plurality of coupling parts 29 each adapted to interact with a complementary coupling part of the support block 15 so as to coupled together the face block 13 and the support block 15, as described later on. Each coupling part 29 is integral with the face block 13 (i.e., not an element distinct from the face block 13). For example, each coupling part 29 may be formed during casting of the face block 13. In this embodiment, each coupling part 29 is a respective female part, which, in this example, is implemented as a respective groove provided on the surface $14_2$. In other embodiments, each coupling part 29 may be a respective male part.

The plurality of coupling parts 29 (in this case, three) allows the face block 13 to be coupled to the support block 15 at different positions relative to the support block 15 and/or to be coupled to the support block 15 and a support block of an adjacent one of the concrete block systems $12_1 \ldots 12_N$. In other embodiments, the face block 13 may include one or any other number of coupling parts.

Figure 9A:
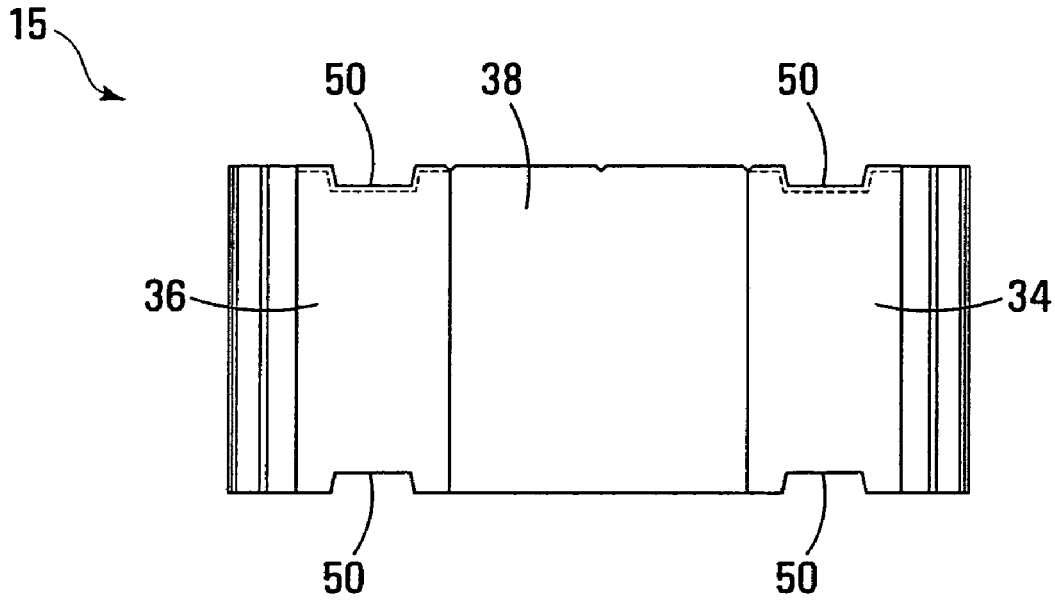
FIGS. 9A and 9B respectively show a side view and a top view of the support block of FIG. 4.
Figure 9B:
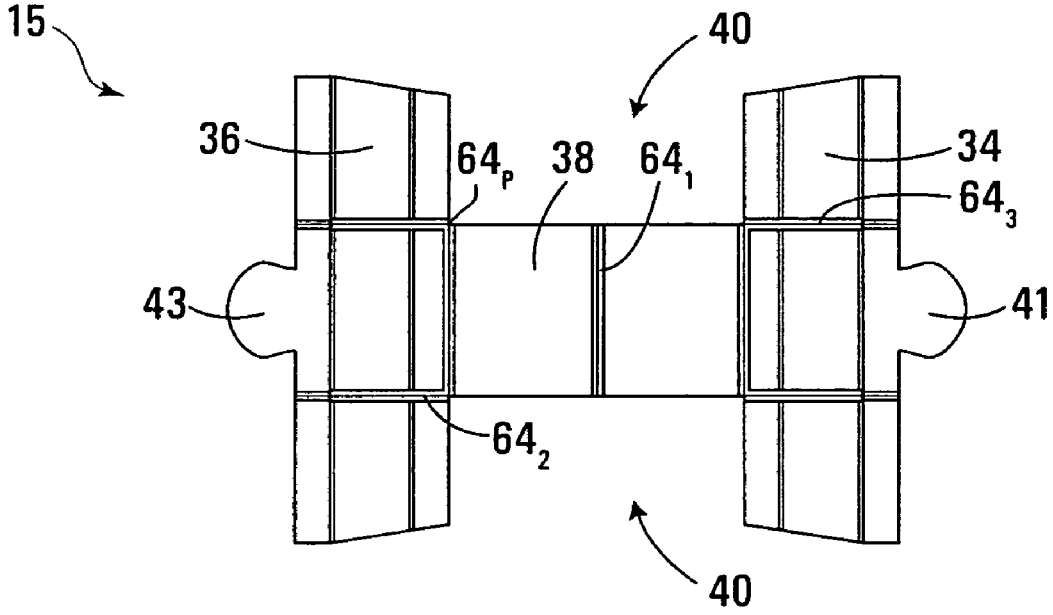

Referring now to FIGS. 4, 9A and 9B, the support block 15 is adapted to be positioned into the material 11 and its structure and weight, along with that of support blocks of other ones of the concrete block systems $12_1 \ldots 12_N$, contribute to effecting retention of the material 11 by the wall portion 10. In this embodiment, the support block 15 is a dry-cast concrete block. In other embodiments, the support block 15 may be made of other types of concrete (e.g., measurable-slump concrete).

The support block 15 comprises a first end portion 34, a second end portion 36, and a central portion 38 therebetween. In this embodiment, the central portion 38 is configured as a neck portion that is relatively narrower than the first end portion 34 and the second end portion 36 such that the support block 15 can be said to have a generally "I"-shaped configuration. This provides a space 40 on each side of the support block 15 that cooperates with a similar space provided by a support block of an adjacent one of the concrete block systems $12_1 \ldots 12_N$ to receive part of the material 11, thereby enhancing stability of the support block 15 while reducing its weight and cost. In other embodiments, the support block 15 may have various other configurations.

In this embodiment, the first end portion 34 has a coupling part 41 that is complementary to each coupling part 29 of the face block 13. This enables the face block 13 to be coupled to the support block 15 by positioning the face block 13 above or below the support block 15 such that one of its coupling parts 29 is aligned with the coupling part 41 of the support block 15 and then fitting the coupling part 41 of the support block 15 into the coupling part 29 of the face block 13. As mentioned previously, in some situations, the face block 13 may simultaneously be coupled to a support block of an adjacent one of the concrete block systems $12_1 \ldots 12_N$ via fitting of another one of its coupling parts 29 with a complementary coupling part of that support block. This may further enhance stability of the wall portion 10. The coupling part 41 is integral with the support block 15 and may be formed during casting of the support block 15. In this embodiment, the coupling part 41 is a male part, which, in this example, is implemented as a protrusion provided on the first end portion 34 and configured to fit into the respective groove forming each coupling part 29 of the face block 13. In other embodiments, the coupling part 41 may be a female part.

Figure 10:
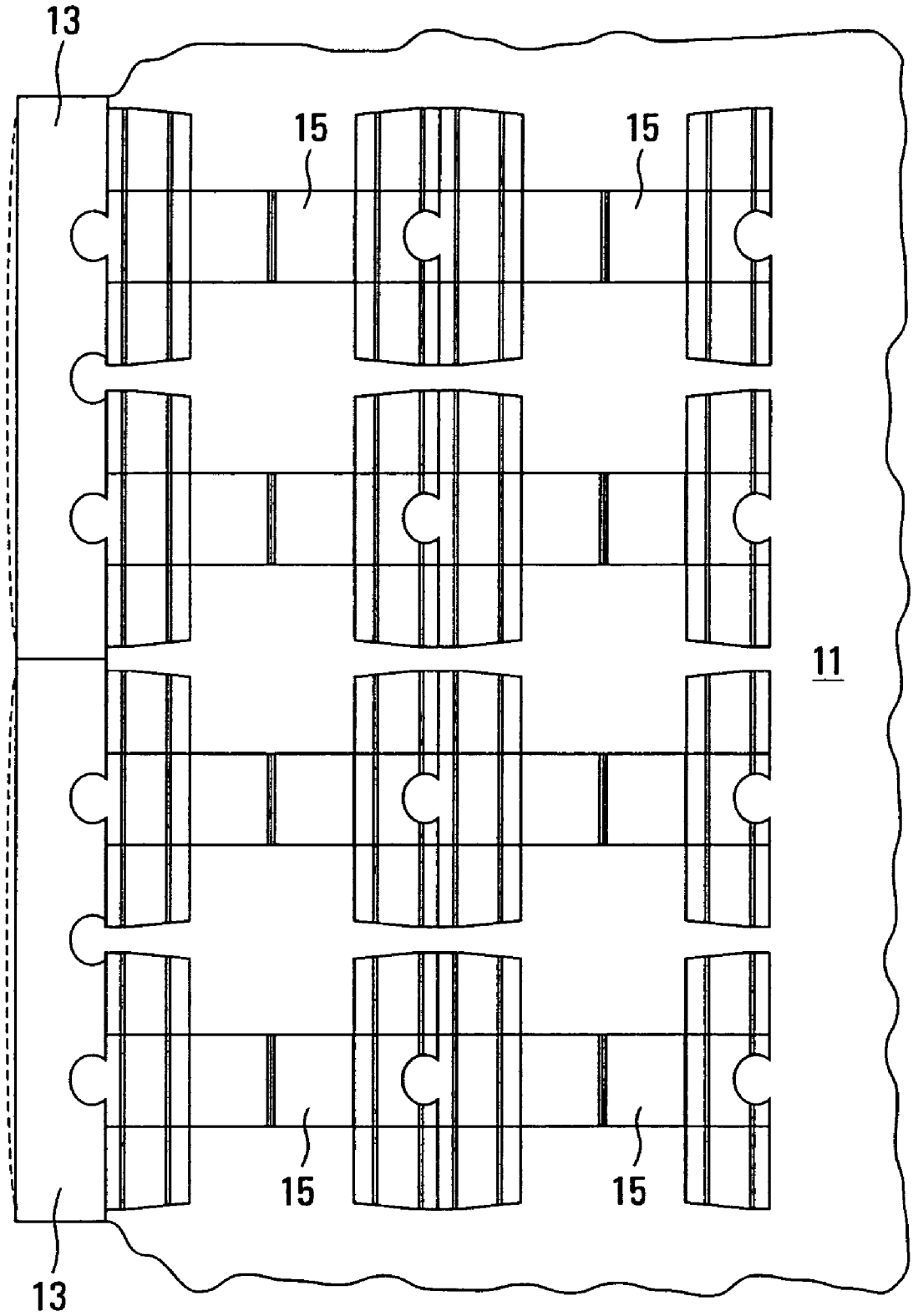
FIG. 10 shows an embodiment in which a wall portion comprises support blocks that are connected in series.
Figure 11A:
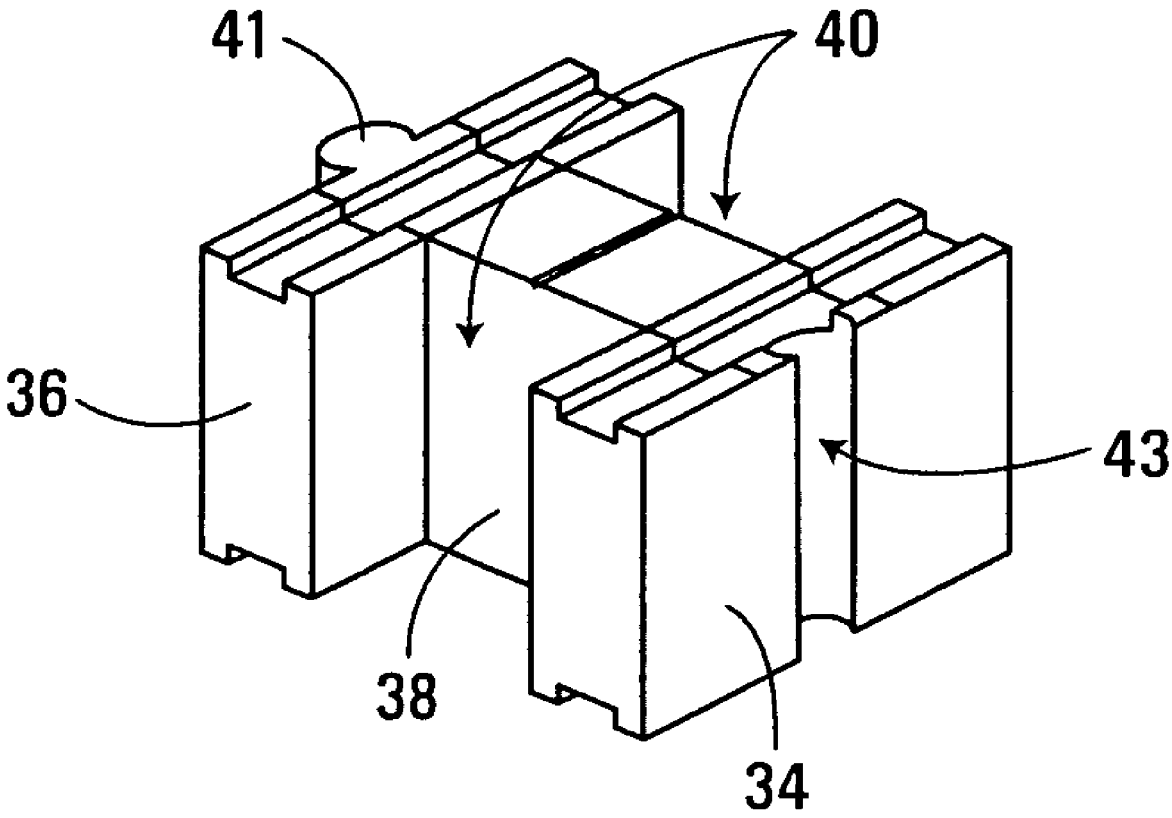
FIGS. 11A to 11C respectively show a perspective view, a side view and a top view of a support block in accordance with another embodiment.
Figure 11B:
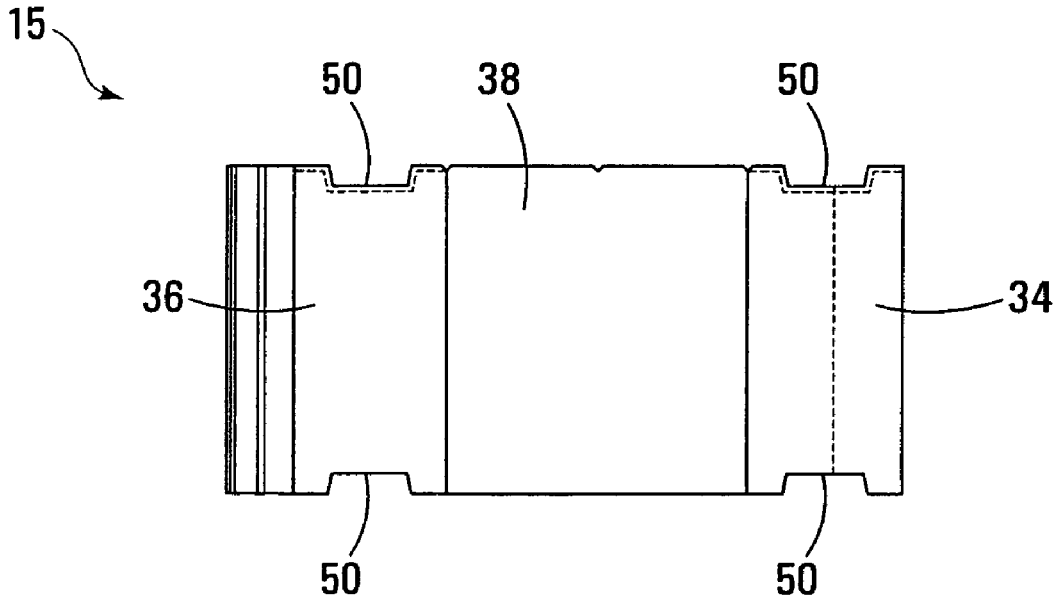
Figure 11C:
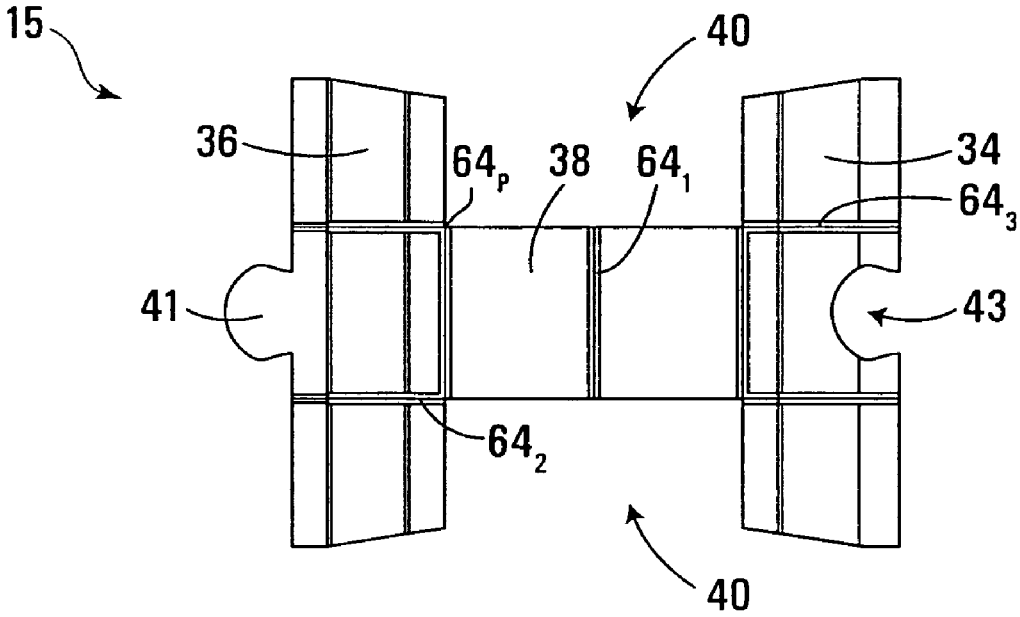

Continuing with FIGS. 4, 9A and 9B, the second end portion 36 has a coupling part 43 that enables the support block 15 to be coupled to another support block. For example, as shown in FIG. 10, it may be useful or necessary in some situations (e.g., relatively high walls) to connect two or more support blocks in series. In such situations, the coupling part 43 of the support block 15 may be coupled to a complementary coupling part of another support block in order to coupled together these two support blocks. In the embodiment of FIGS. 4, 9A and 9B, the coupling part 43 is integral with the support block 15 and may be formed during casting of the support block 15. Also, the coupling part 43 is a male part, which, in this example, is implemented as a protrusion provided on the second end portion 36 and configured to fit into a complementary female part of another support block. In other embodiments, the coupling part 43 may be a female part. For example, FIGS. 11A to 11C illustrate an embodiment in which the support block 15 has a male coupling part 41 and a female coupling part 43.

In the embodiment shown in FIGS. 4, 9A and 9B, each of the first end portion 34 and the second end portion 36 is provided with a respective depression 50 on each of its top and bottom sides. The depression 50 can take the form of a groove or a recess. The depression 50 can also be an open-ended groove extending from one side to the other side of the support block 15. As shown in FIG. 2, each depression 50 is adapted to receive an alignment key 52 that may be used to adjust an angle θ of the support block 15 relative to an overlapping support block of the concrete block systems $\mathbf{12}_1 \ldots \mathbf{12}_N$. This enables the wall portion 10 to have a corresponding setback angle or slope.

Figure 12:
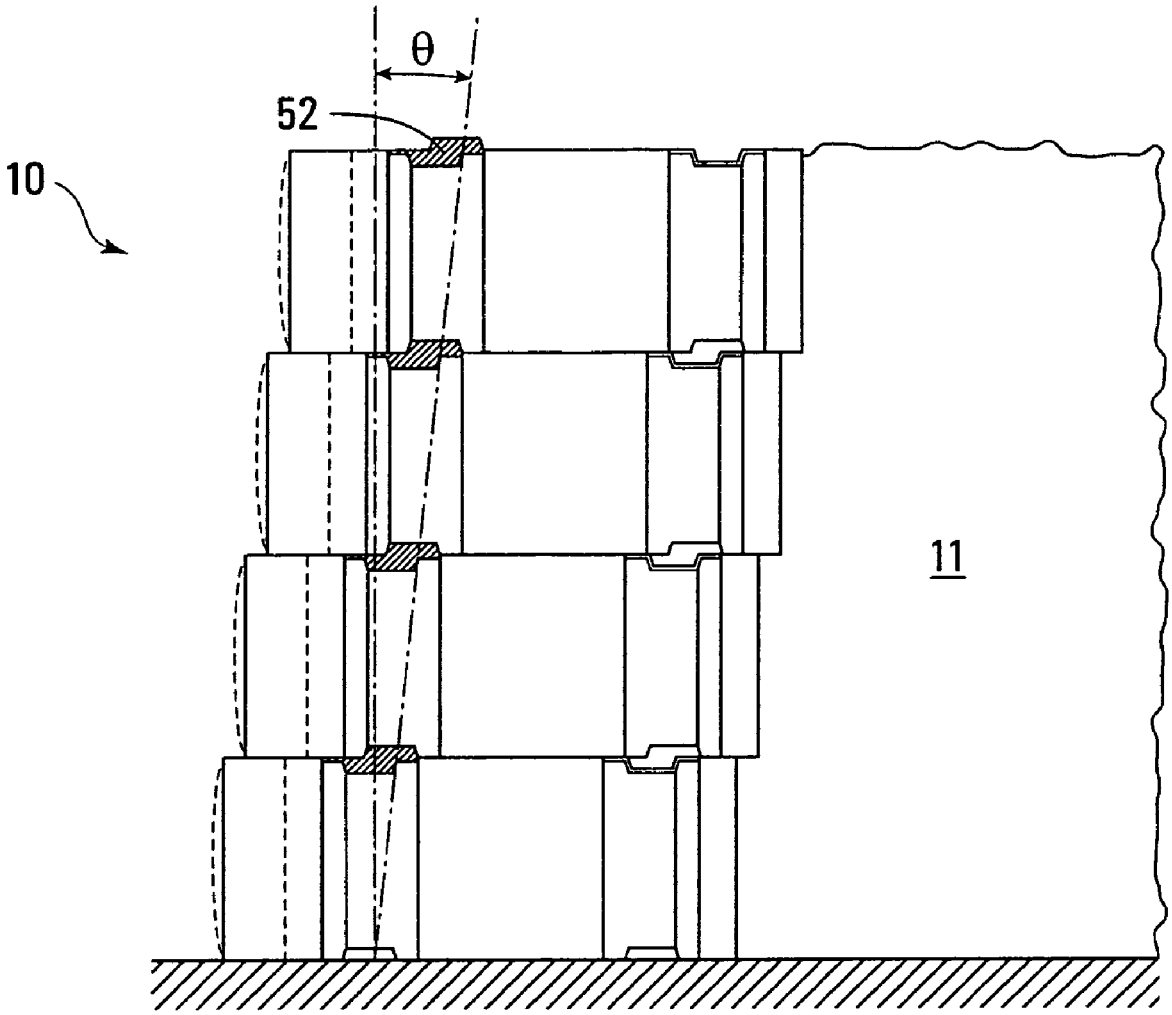
FIG. 12 shows an embodiment in which a wall portion has a nonzero setback angle, illustrating use of alignment keys.

More particularly, the alignment key 52 may be placed in different positions in a given depression 50 to effect the desired angle θ. For example, in FIG. 2, each alignment key 52 is placed in a first position, wherein it is aligned longitudinally with and entirely lies within the respective depressions 50 in which it is placed. In this case, the angle θ is substantially zero degrees and it is then possible to erect a wall that is substantially vertical. In FIG. 12, each alignment key 52 is placed in a second position different from the first position, wherein it partly overhangs support block portions contiguous to the respective depressions 50 in which it is placed. In this case, the angle θ has a nonzero value such as 7°, 10° or any other permitted value, and it is then possible to erect an inclined wall.

Figure 13A:
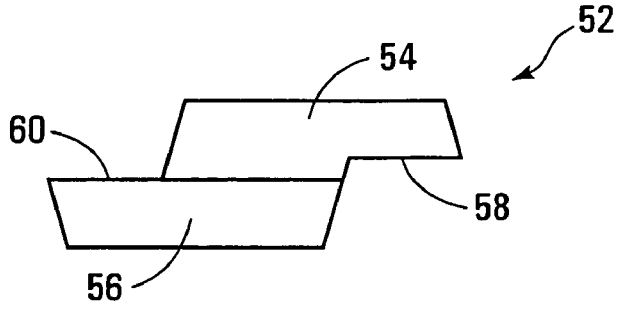
FIGS. 13A to 13C respectively show a side view, a front view and a top view of an embodiment of one of the alignment keys of FIG. 12.
Figure 13B:
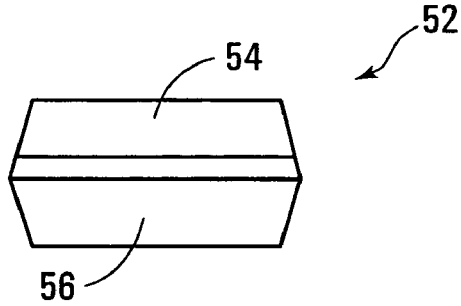
Figure 13C:
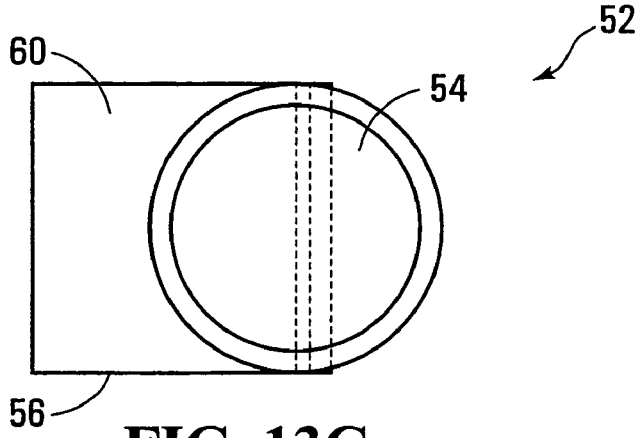

FIGS. 13A to 13C illustrates an example of implementation of the alignment key 52. The alignment key 52 comprises a first portion 54 and a second portion 56 that respectively define overhang sections 58 and 60. Placing the alignment key 52 in a given depression 50 of the support block 15 such that both of the overhang sections 58 and 60 lie within the depression 50 achieves a zero degree value for the angle θ (e.g., FIG. 2). When the alignment key 52 is placed such that one of the overhang sections 58 and 60 overhangs a portion of the support block 15 contiguous to the depression 50, a nonzero degree value for the angle θ is achieved (e.g., FIG. 12). In one embodiment, the alignment key 52 is made of a polymeric material such as polypropylene. In other embodiments, the alignment key 52 may be made of various other materials.

While in the embodiment of FIGS. 4, 9A and 9B each depression 50 is shown as having a certain configuration and as being located at a certain location on the first end portion 34 or the second end portion 36, in other embodiments, each depression 50 may have various other configurations and may be located at various other locations on the support block 15. Also, although in the embodiment of FIGS. 4, 9A and 9B the alignment key 52 is an element distinct from the support block 15, in other embodiments, the support block 15 may be provided with an alignment key that is integral with the support block 15 (e.g., a male or female key part).

Figure 14:
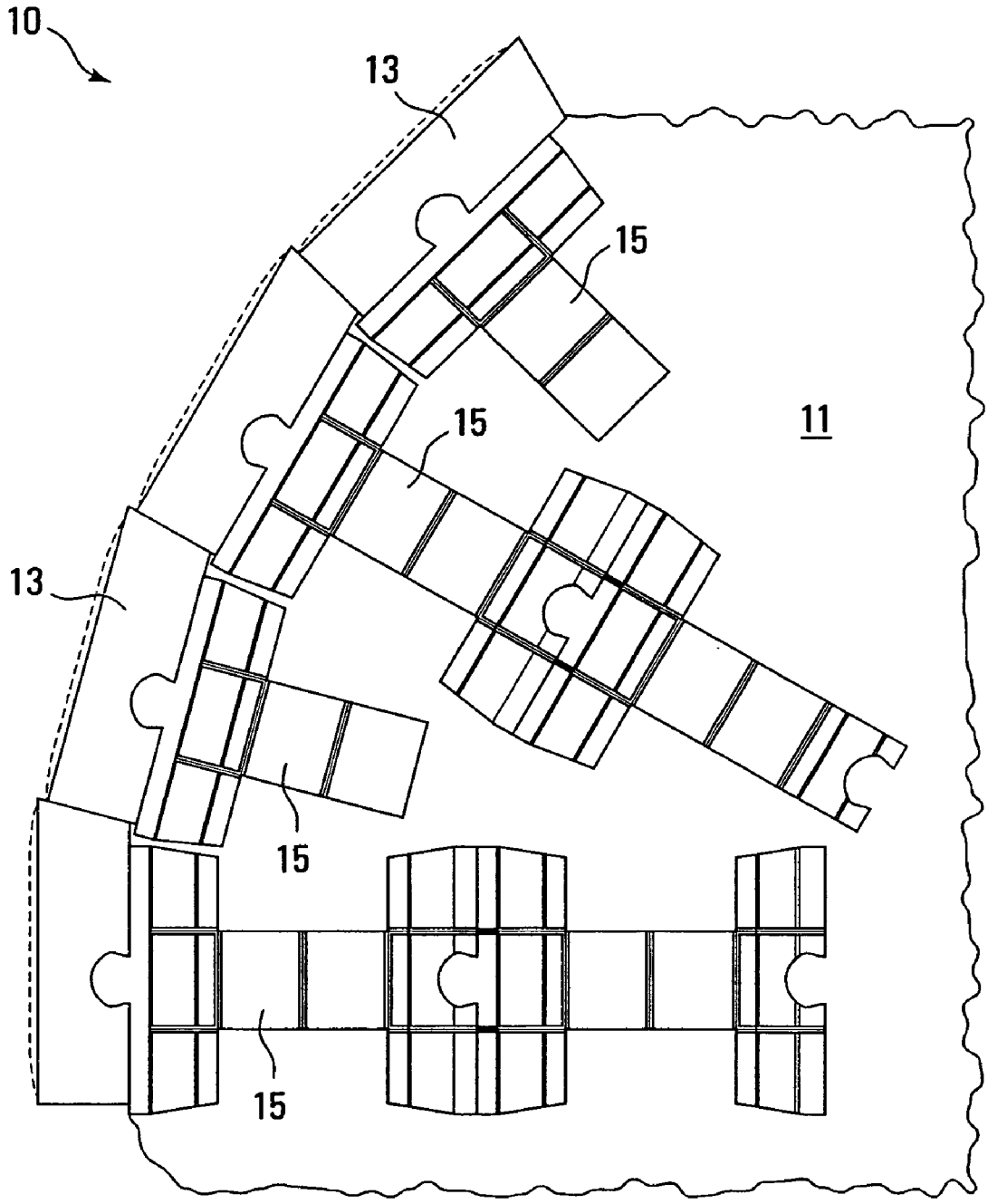
FIG. 14 shows an embodiment in which a wall portion is curved.

Continuing with FIGS. 4, 9A and 9B, the support block 15 has a plurality of fractionation areas $\mathbf{64}_1 \ldots \mathbf{64}_P$ for facilitating controlled fractionating of the support block 15 into separate parts. In this embodiment, each of the fractionation areas $\mathbf{64}_1 \ldots \mathbf{64}_P$ is implemented as a respective groove formed on the support block 15 and sized to facilitate controlled mechanical splitting (e.g., cutting, sawing, etc.) of the support block 15 at that area. This enables removal of selected portions of the support block 15 such as the first end portion 34, the second end portion 36, the central portion 38, or fractions thereof in order to reconfigure the support block 15 such that it may accommodate design requirements of the wall portion 10. For example, FIG. 14 illustrates an embodiment in which the wall portion 10 is curved and selected portions of certain support blocks 15 have been removed in order to accommodate the wall portion's curved aspect. It will be appreciated that removal of selected support block portions may be effected for various other situations/design requirements.

It will thus be appreciated that when the concrete block systems $\mathbf{12}_1 \ldots \mathbf{12}_N$ are positioned in the wall portion 10, the natural stone-like surface portion 16 of the face block 13 of each concrete block system contributes to providing a natural and aesthetic look to the wall portion 10. For its part, the support block 15 of each concrete block system contributes to effecting retention of the material 11 by the wall portion 10, may interact with the alignment key 52 to provide a desired setback angle θ to the wall portion 10, and may be selectively reconfigured so as to accommodate design requirements of the wall portion 10. Furthermore, the natural stone appearance of each face block 13 may be realized during casting thereof, without requiring any subsequent mechanical artificial aging/weathering process (e.g., tumbling, splitting/breaking, object impacting, etc.). Moreover, since they may be made of no-slump concrete, production time for the concrete block systems $\mathbf{12}_1 \ldots \mathbf{12}_N$ may be significantly less than that required for wet-cast concrete blocks. Concrete block systems such as the concrete block systems $\mathbf{12}_1 \ldots \mathbf{12}_N$ may therefore be mass-produced with high efficiency.

Figure 15:
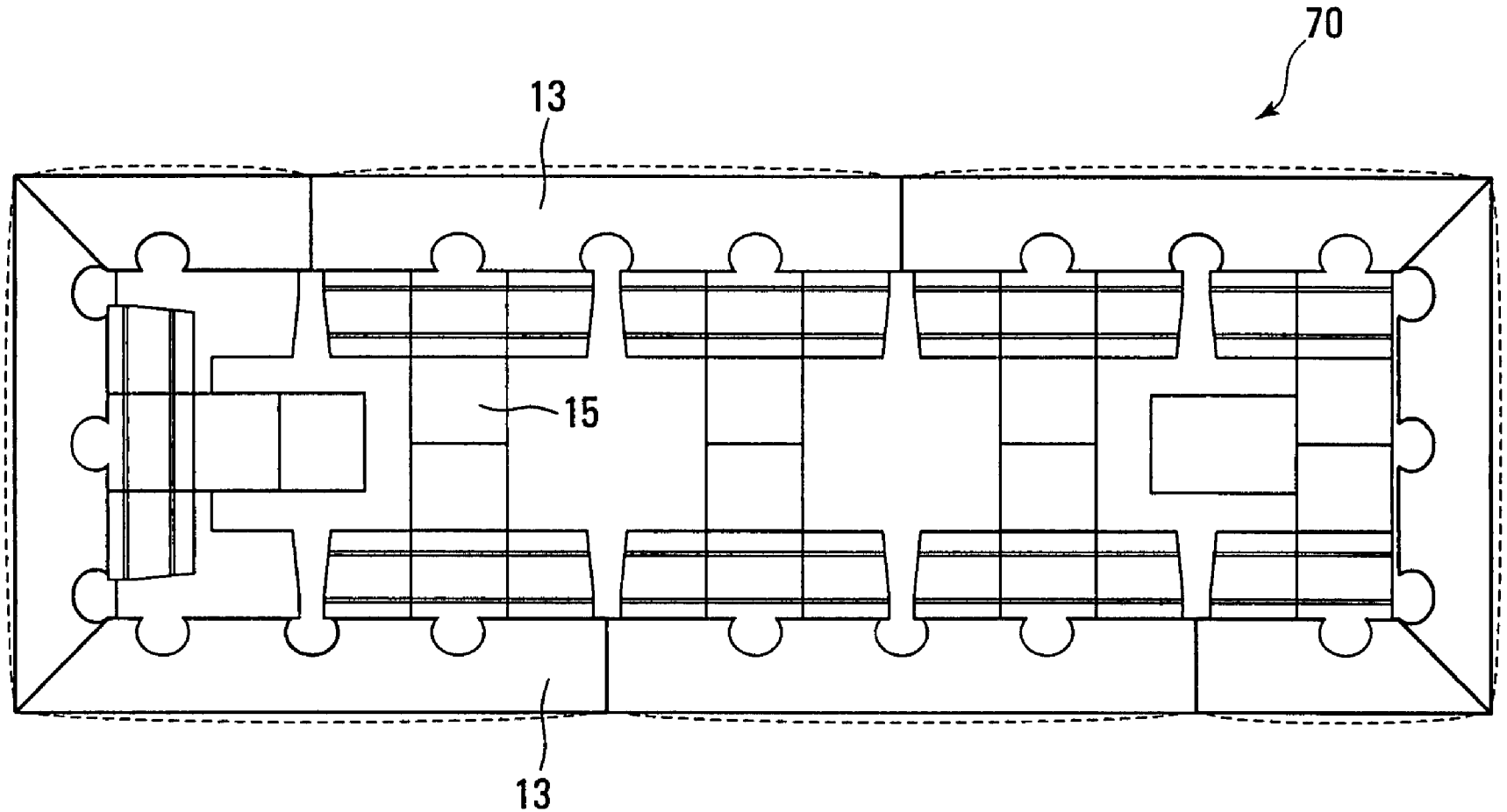
FIG. 15 to 18 show wall portions comprising a plurality of concrete block systems in accordance with various embodiments of the invention.
Figure 16:
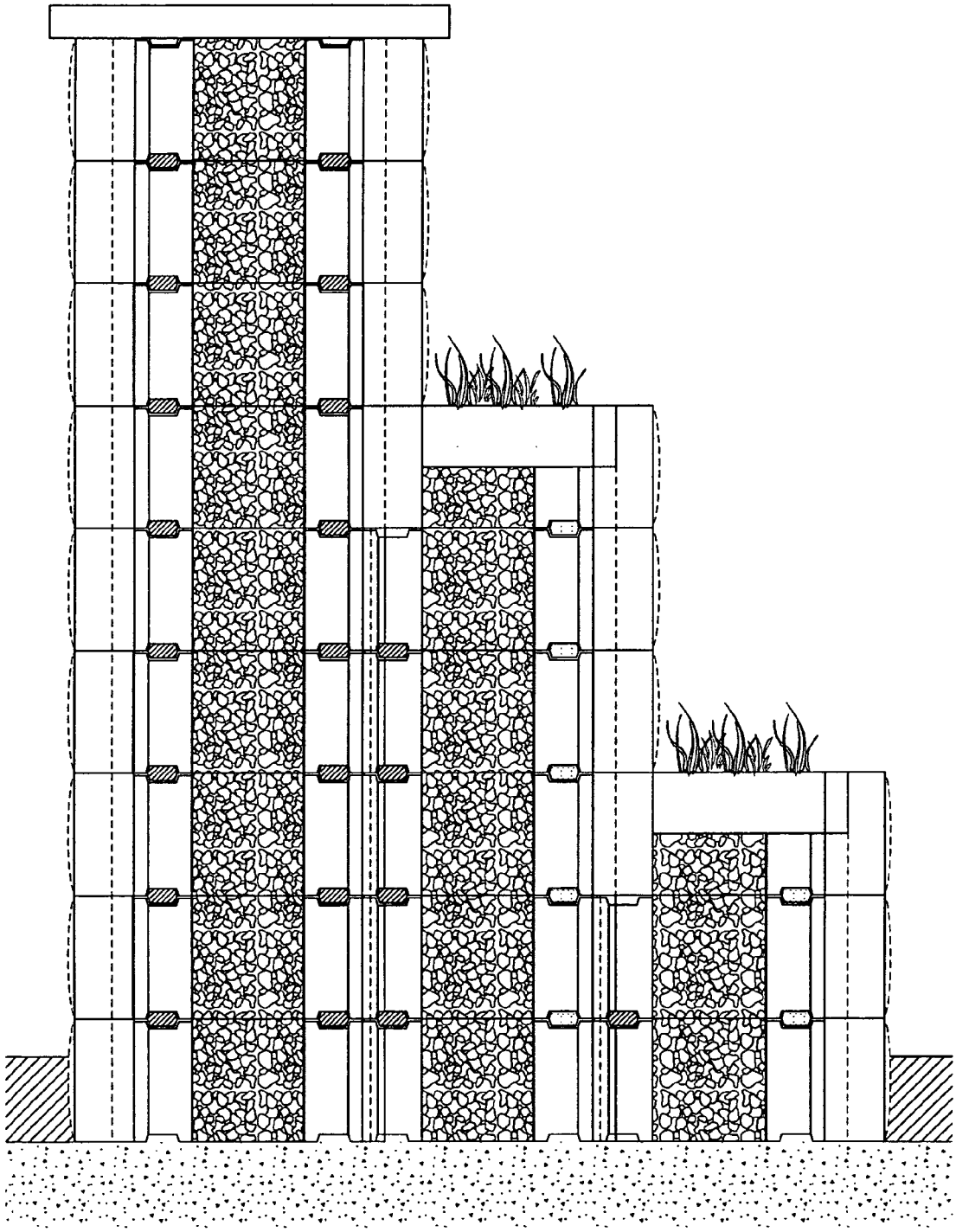
Figure 17:
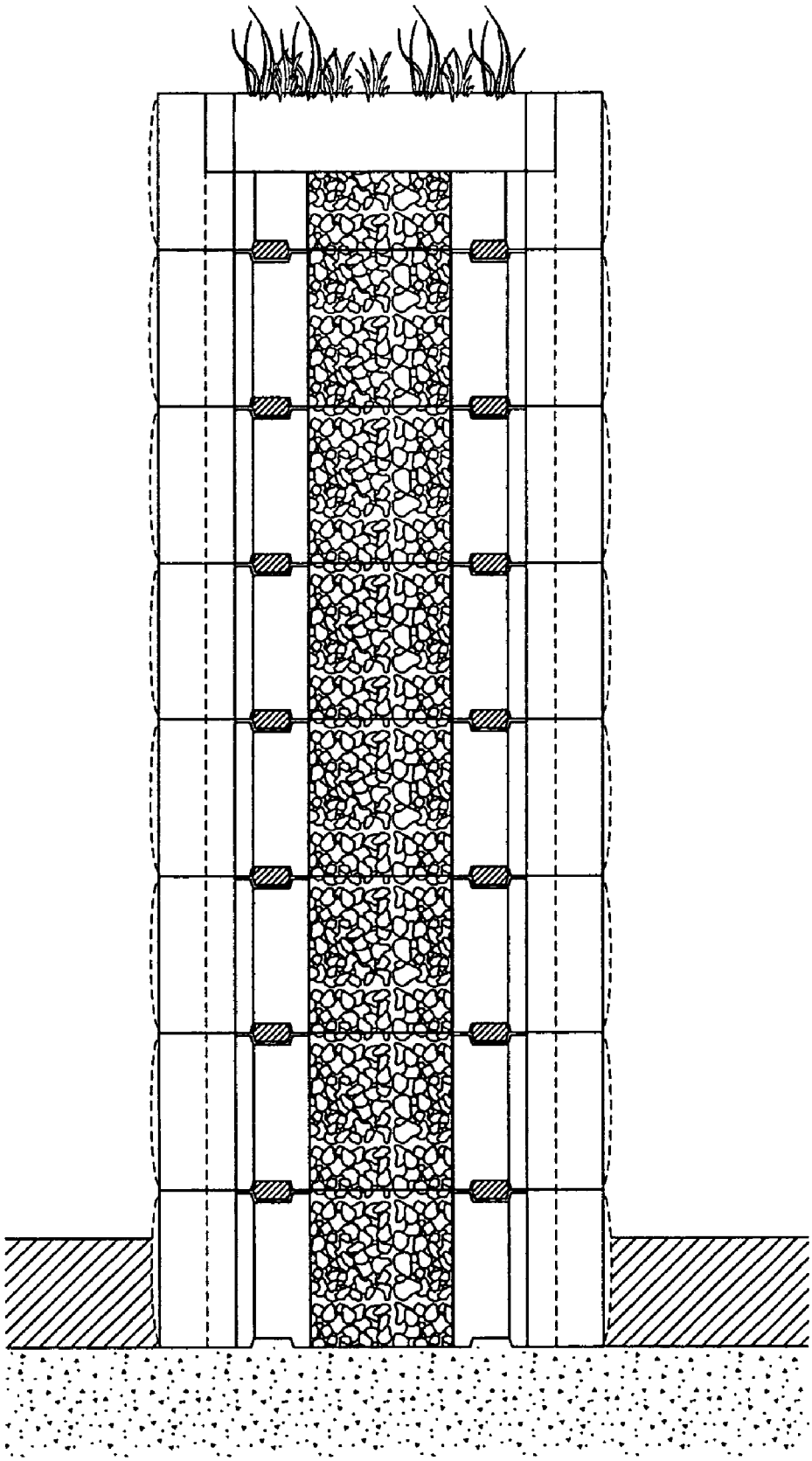
Figure 18:
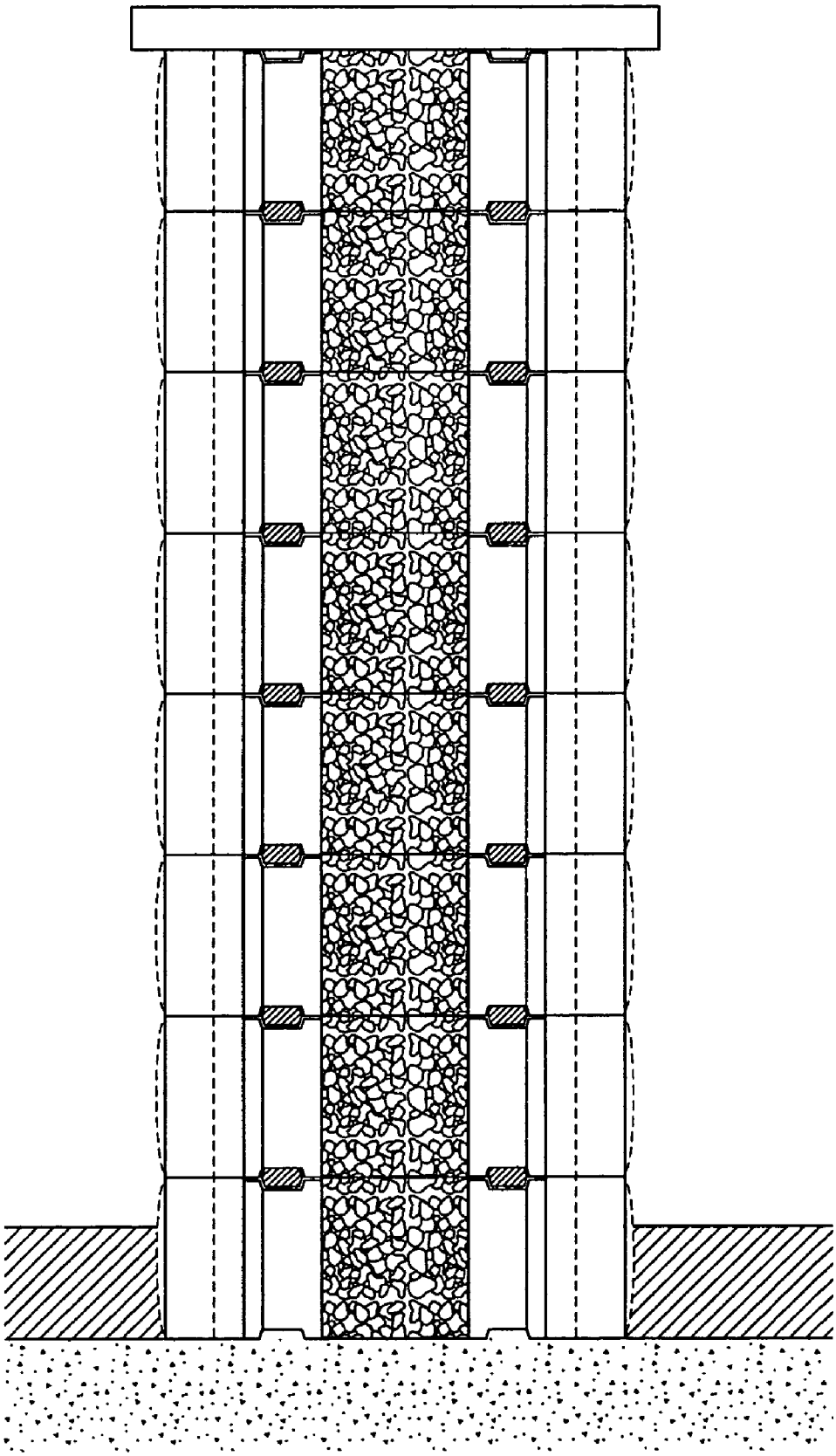

Although the above-described embodiments relate to a retaining wall application, concrete block systems in accordance with other embodiments of the invention may be used in various other types of walls. For example, FIG. 15 shows an embodiment in which a freestanding wall portion 70 is constructed with concrete block systems such as the concrete block systems $\mathbf{12}_1 \ldots \mathbf{12}_N$. This example illustrates that, in certain embodiments, the support block 15 of a concrete block system may be coupled to two face blocks 13 via the coupling part 41 of its first end portion 34 and the coupling part 43 of its second end portion 36. This example also illustrates that removal of selected support block portions may be effected to accommodate design requirements of the freestanding wall portion 70. As another example, FIGS. 16 to 18 show embodiments in which concrete block systems such as the concrete block systems $\mathbf{12}_1 \ldots \mathbf{12}_N$ are used to construct other types of walls (e.g., acoustic walls, etc.).

Figure 19:
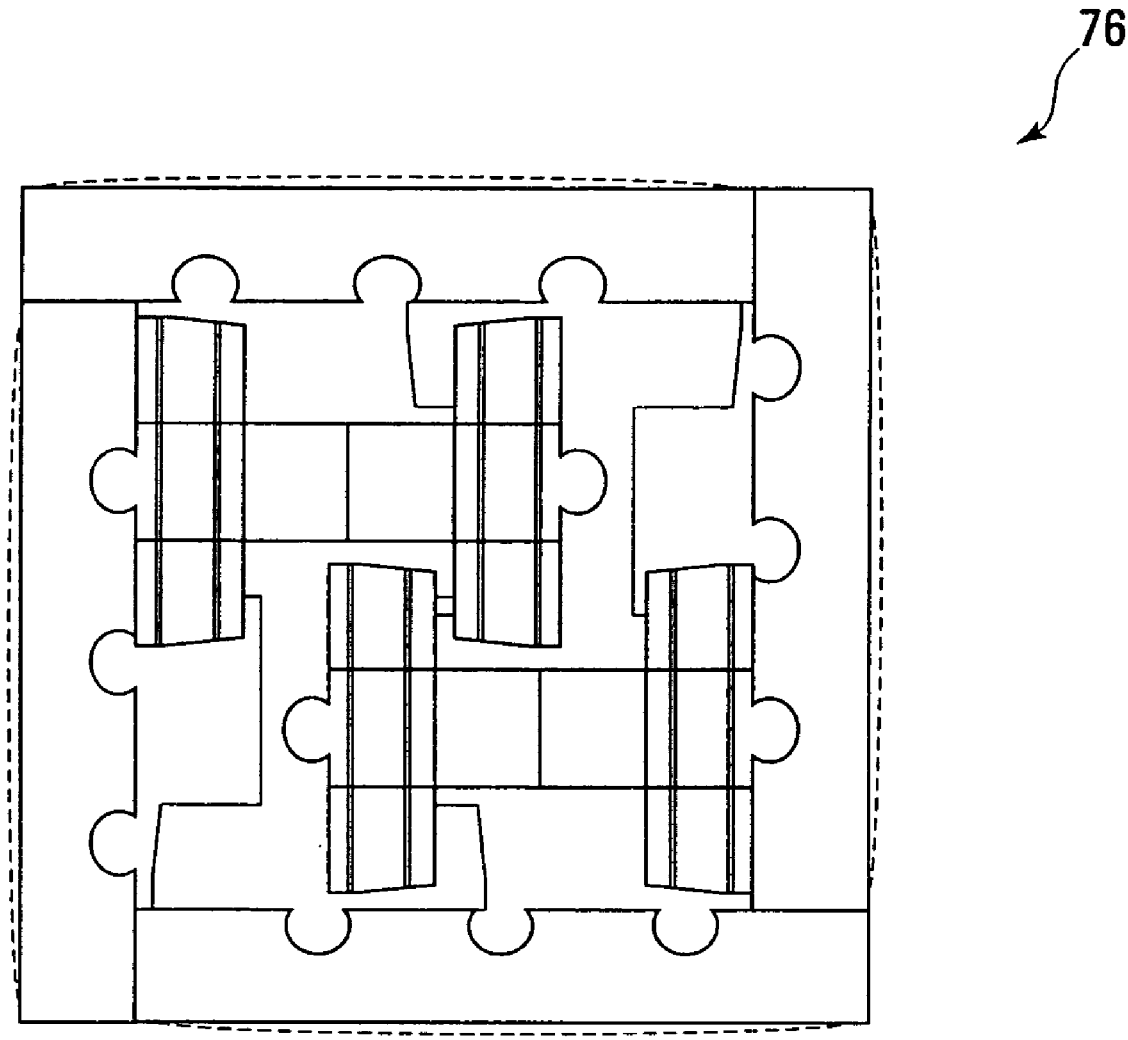
FIG. 19 shows a column portion comprising a plurality of concrete block systems in accordance with another embodiment of the invention.
Figure 20:
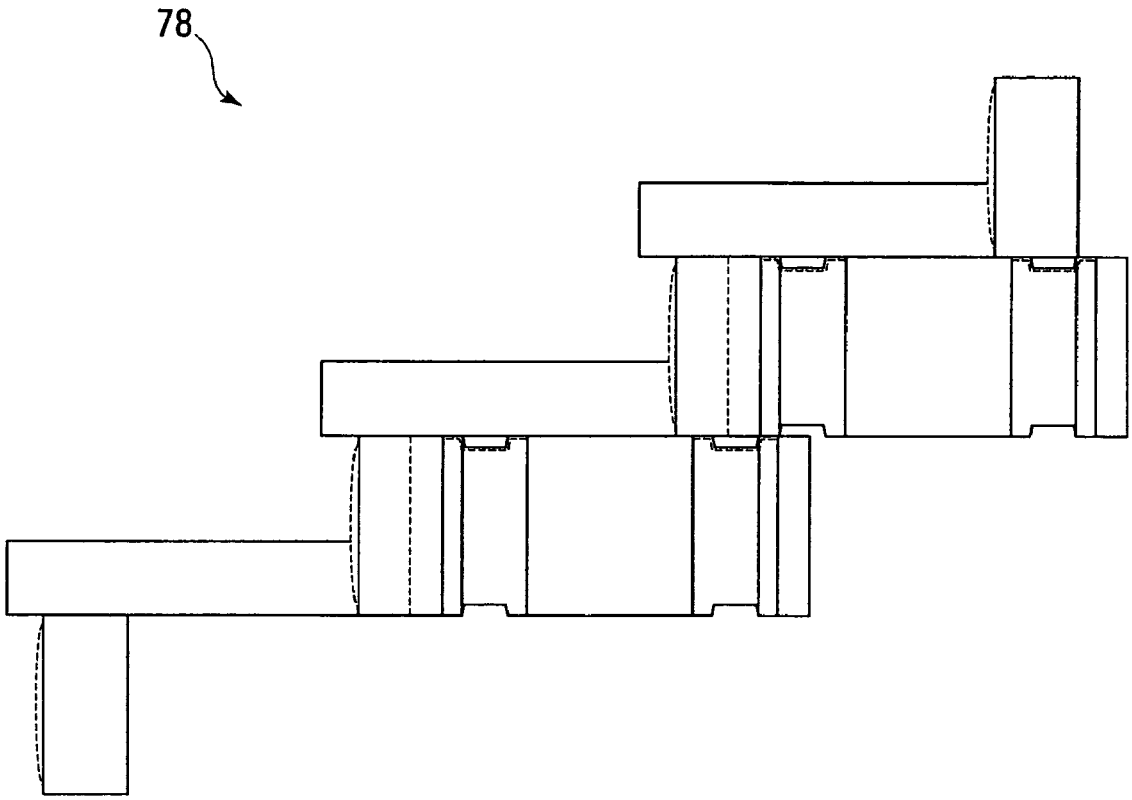
FIG. 20 shows steps comprising a plurality of concrete block systems in accordance with yet another embodiment of the invention.

In addition, concrete block systems in accordance with embodiments of the invention are not limited to wall applications but may also be used in various other types of structures. For example, FIG. 19 shows an embodiment in which a column portion 76 is constructed with concrete block systems such as the concrete block systems $\mathbf{12}_1 \ldots \mathbf{12}_N$. As another example, FIG. 20 shows an embodiment in which steps 78 are constructed with concrete block systems such as the concrete block systems $\mathbf{12}_1 \ldots \mathbf{12}_N$.

Figure 21:
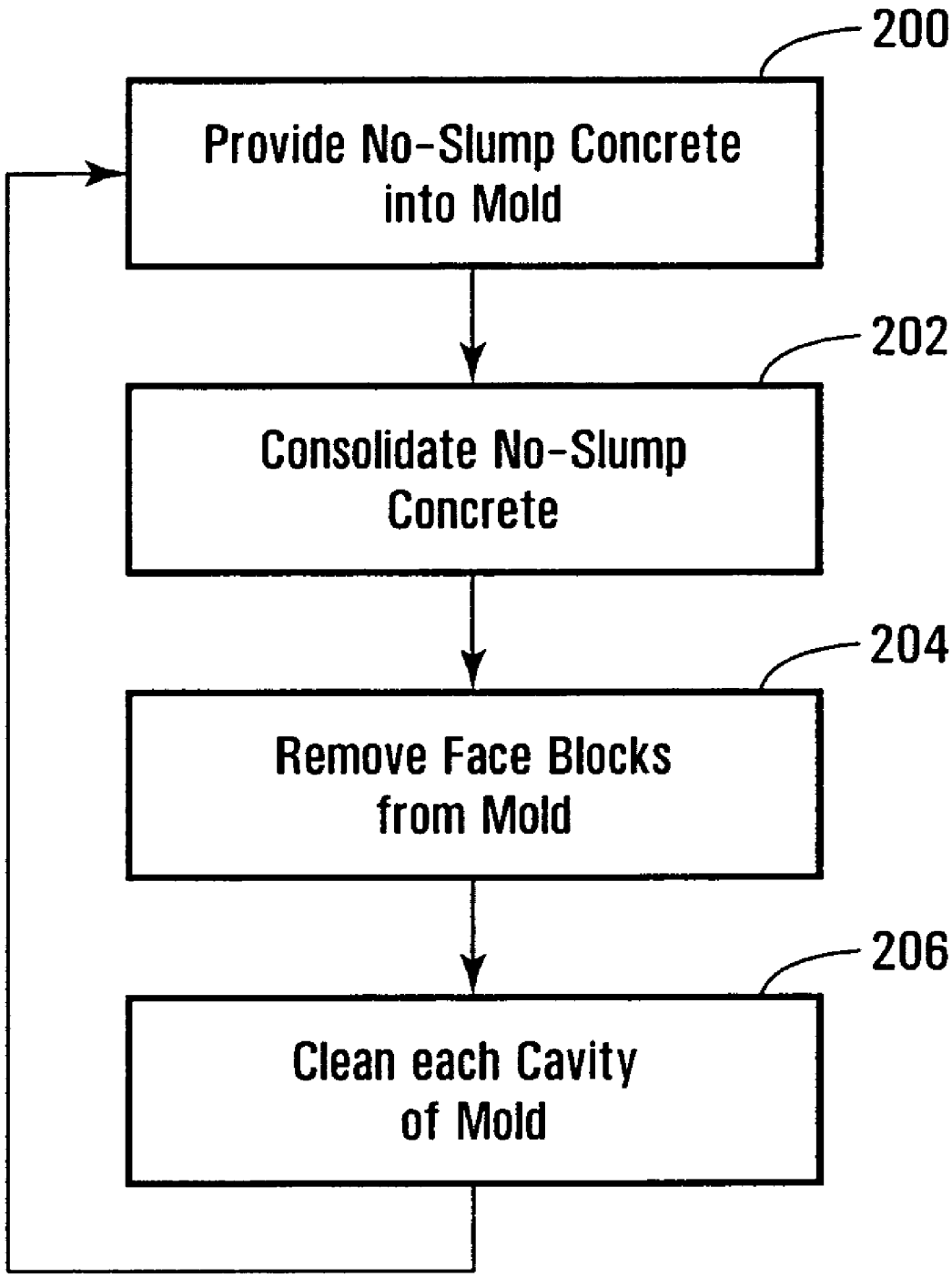
FIG. 21 is a flowchart illustrating an example of implementation of a process for manufacturing face blocks in accordance with an embodiment of the invention.

Referring now to FIG. 21, there is shown a flowchart illustrating an example of implementation of a process for manufacturing face blocks of concrete block systems such as the above-described concrete block systems $\mathbf{12}_1 \ldots \mathbf{12}_N$.

At step 200, no-slump concrete is placed into a mold. To facilitate mass-production, in one embodiment, the mold has a plurality of cavities. In other embodiments, a plurality of molds each with a single cavity or each with a respective plurality of cavities may be used. To further facilitate mass-production, the mold may be located such that face blocks are placed on a production board when removed therefrom.

Each cavity of the mold is configured to form a respective face block comprising a surface that includes a natural stone-like surface portion (e.g., the face block 13 with its natural stone-like surface portion 16). To that end, each cavity is defined in part by a surface of the mold that comprises a portion with a surface texture corresponding to the desired natural stone appearance (hereinafter referred to as "the natural stone-like surface portion of the mold"). This surface portion thus defines a surface level difference ΔL' that corresponds to the desired surface level difference ΔL (FIG. 5) of the face block to be formed. Each point of this surface portion also defines a respective texture angle θ' corresponding to the desired texture angle θ (FIG. 5) of each point of the face block to be formed.

It will be appreciated that, in embodiments directed to producing face blocks with a plurality of natural stone-like surface portions (such as those shown in FIGS. 8A and 8B), each cavity of the mold that is intended to form such face blocks defines a corresponding plurality of natural stone-like surface portions.

In order to closely simulate natural stone, in one embodiment, each given natural stone-like surface portion of the mold, and thus the corresponding natural stone-like surface portion of face blocks to be formed by the mold, is based on a natural stone's surface. In one example of implementation, data representative of at least a portion of the natural stone's surface is obtained, for instance, via three-dimensional scanning of the natural stone's surface. The obtained data may then be computer processed using software in order to generate data representative of the given natural stone-like surface portion of the mold. In some cases, this processing may include modifying the obtained data representative of at least a portion of the natural stone's surface to set the desired surface level difference ΔL' and texture angles θ' of the given natural stone-like surface portion. This processing may also ensure that the data representative of the given natural stone-like surface portion of the mold will result in the corresponding natural stone-like surface portion of face blocks to be formed by the mold having at least three points that are located relative to each other such that at least one other concrete block may be supported thereon in a stable manner.

As another possible consideration, in embodiments where individual ones of the cavities of the mold are intended to form concrete blocks of similar overall dimensions (i.e., length, width and height) but with natural stone-like surface portions that have different configurations (e.g., different patterns of cast relief elements), these individual cavities may be designed to each have a common volume in order to facilitate production. In other words, a first cavity intended to form concrete blocks with natural stone-like surface portions having a first configuration may have a first volume, and a second cavity intended to form concrete blocks with natural stone-like surface portions having a second configuration different from the first configuration may have a second volume substantially corresponding to the first volume. This facilitates provision of substantially the same quantity of concrete into each cavity of the mold, which in turn facilitates efficient casting of concrete blocks in the mold and subsequent removal of the concrete blocks therefrom.

In embodiments where individual ones of the cavities of the mold are intended to form concrete blocks of significantly different overall dimensions (i.e., length, width and height) and with natural stone-like surface portions that have different configurations (e.g., different patterns of cast relief elements), similar production benefits may be achieved by designing these individual cavities to each have a common volume per unit area.

The mold may be manufactured via computer-aided manufacturing based on the data representative of each given natural stone-like surface portion of the mold. With no-slump concrete being used, the mold may be made of metal or other rigid material. There is no requirement for one or more portions of the mold to be made of elastomeric material (e.g., rubber), which is typically used in molds for casting wet-cast concrete blocks with a natural stone appearance.

Thus, during step 200, each cavity of the mold is filled with no-slump concrete in order to form a face block with at least one natural stone-like surface portion.

At step 202, the no-slump concrete in the mold is consolidated. Consolidation may include inducing vibration of the no-slump concrete in the mold so as to cause it to compact itself and closely conform to each cavity of the mold. A pre-vibration phase may be effected during step 200 to facilitate filling of the no-slump concrete in the mold and its eventual consolidation. Consolidation may also include application of pressure on the concrete in combination with its vibration. It will be appreciated that consolidation may be effected using various other techniques.

Upon completion of step 202, the no-slump concrete in each cavity of the mold has formed into a face block with at least one natural stone-like surface portion.

At step 204, the face block in each cavity of the mold is removed therefrom and continues on the production board. The face blocks may be directly stored for curing purposes. Since provision of a natural stone appearance is effected during casting, the face blocks do not require a subsequent mechanical artificial aging/weathering process (e.g., tumbling, splitting/breaking, object impacting, etc.) to impart them with such an appearance. Also, the face blocks may directly be stacked or palletized in a stable manner since the at least one natural stone-like surface portion of each face block has been configured to provide at least three points that are located relative to each other to ensure such stable supporting. With the face blocks being made of no-slump concrete, curing times are relatively short such that they are available for use within a short period of time (e.g., one day).

At step 206, each cavity of the mold is cleaned such that casting of new face blocks may be effected. In one embodiment, a cleaning unit uses a fluid to clean each cavity of the mold. The fluid may be a gas (e.g., compressed air) or a liquid whose flow relative to each cavity of the mold, and particularly each natural stone-like area of the mold, removes therefrom substantially any remaining no-slump concrete. Such a fluid-based cleaning action advantageously enables rapid cleaning of each cavity of the mold, thereby increasing production efficiency. In some cases, the cleaning unit may also use, in addition to the fluid, one or more brushes to clean each cavity of the mold, whereby the fluid-based cleaning action is combined with a brushing cleaning action. It will be appreciated that other embodiments may employ various other types of cleaning action.

As shown in FIG. 21, in this example, the process returns to step 200 where a new production cycle begins. In some embodiments, utilization of no-slump concrete in combination with rapid cleaning of the mold and other elements of the process may enable a production cycle to take a relatively short period of time (e.g., 15 to 20 seconds in some cases).

With respect to manufacturing of support blocks of concrete block systems such as the above-described concrete block systems $\mathbf{12}_1 \ldots \mathbf{12}_N$, it will be appreciated that various conventional casting processes may be used.

Although various embodiments and examples have been presented, this was for the purpose of describing, but not limiting, the invention. Various modifications and enhancements will become apparent to those of ordinary skill in the art and are within the scope of the present invention, which is defined by the attached claims.

The invention claimed is:

1. A concrete block system for use in a structure, said concrete block system comprising:

a support block comprising a first coupling part; and a dry-cast face block made by a dry-casting process and comprising a second coupling part, said first coupling part and said second coupling part enabling said dry-cast face block to be coupled to said support block, said dry-cast face block comprising a surface adapted to be exposed when said dry-cast face block is coupled to said support block and said concrete block system is positioned in the structure, said surface including a portion having a cast texture with a natural stone appearance that comprises a pattern of cast relief elements formed during the dry-casting process.

2. A concrete block system as claimed in claim 1, wherein said first coupling part is one of a male coupling part and a female coupling part, and said second coupling part is the other one the male coupling part and the female coupling part.

3. A concrete block system as claimed in claim 1, wherein each of at least one of said first coupling part and said second coupling part is a respective cast coupling part.

4. A concrete block system as claimed in claim 1, wherein said support block comprises a first end portion, a second end portion, and a central portion therebetween, said central portion being narrower than said first end portion and said second end portion.

5. A concrete block system as claimed in claim 1, wherein said support block comprises a first end portion and a second end portion, said first coupling part being located on said first end portion, said support block comprising a third coupling part located on said second end portion, said third coupling part enabling said support block to be coupled to one of another support block and another dry-cast face block.

6. A concrete block system as claimed in claim 1, wherein said support block comprises a depression for receiving an alignment key adapted to set an angle of said support block relative to an overlapping support block.

7. A concrete block system as claimed in claim 1, wherein said support block comprises an integral alignment key adapted to set an angle of said support block relative to an overlapping support block.

8. A concrete block system as claimed in claim 1, wherein said support block comprises at least one fractionation area each for controllably fractionating said support block into separate parts.

9. A concrete block system as claimed in claim 8, wherein said at least one fractionation area comprises a plurality of fractionation areas.

10. A concrete block system as claimed in claim 1, wherein said dry-cast face block comprises a third coupling part enabling at least one of:

said dry-cast face block to be coupled to said support block at a different position relative to said support block than that enabled by said second coupling part; and said dry-cast face block to be coupled to another support block.

11. A concrete block system as claimed in claim 1, wherein said cast texture has a surface level difference of greater than 4 mm.

12. A concrete block system as claimed in claim 11, wherein said surface level difference is greater than 15 mm.

13. A concrete block system as claimed in claim 11, wherein each of a plurality of points of said cast texture defines a respective texture angle between 75° and 90°.

14. A concrete block system as claimed in claim 11, wherein said cast texture comprises at least one valley each having a respective depth greater than 4 mm.

15. A concrete block system as claimed in claim 1, wherein said portion of said surface is an entirety of said surface.

16. A concrete block system as claimed in claim 1, wherein said portion of said surface is a first portion of said surface and said cast texture is a first cast texture, said surface comprising (1) a second portion with a second cast texture having a natural stone appearance and (2) a third portion without a cast texture having a natural stone appearance and that separates said first portion and said second portion.

17. A concrete block system as claimed in claim 1, wherein the structure is a wall and said concrete block system is a wall block system.

18. A concrete block system as claimed in claim 17, wherein the wall is a retaining wall and said wall block system is a retaining wall block system.

19. A concrete block system as claimed in claim 1, wherein the structure is a column and said concrete block system is a column block system.

20. A concrete block system as claimed in claim 1, wherein the structure is steps and said concrete block system is a steps block system.

21. A plurality of concrete blocks for use in a retaining wall, said plurality of concrete blocks comprising:

first and second support blocks adapted to be embedded in material to be retained by the retaining wall, said first support block comprising one of a first protrusion and a first groove, said second support block comprising one of a second protrusion and a second groove; and a dry-cast face block made by a dry-casting process and having a surface that is exposed when said dry-cast face block is positioned in the retaining wall, said surface including a portion having a cast texture with a natural stone appearance that comprises a pattern of cast relief elements formed during the dry-casting process, said dry-cast face block comprising the other one of said first protrusion and said first groove and the other one of said second protrusion and said second groove, said dry-cast face block being configured such that, when said dry-cast face block and said first and second support blocks are positioned in the retaining wall, said dry-cast face block is coupled to said first support block via said first protrusion fitting into and being surrounded by said first groove and to said second support block via said second protrusion fitting into and being surrounded by said second groove.

22. A plurality of concrete blocks as claimed in claim 21, wherein each of said first and second support blocks comprises a first end portion, a second end portion, and a central portion therebetween, said central portion being narrower than said first end portion and said second end portion.

23. A plurality of concrete blocks as claimed in claim 21, wherein each of said first and second support blocks comprises a first end portion and a second end portion, the one of said first protrusion and said first groove being a located on said first end portion of said first support block, the one of said second protrusion and said second groove being located on said first end portion of said second support block, each of said first and second support blocks comprising a coupling part located on said second end portion, said coupling part enabling each of said first and second support blocks to be coupled to another support block.

24. A plurality of concrete blocks as claimed in claim 21, wherein each of said first and second support blocks comprises a depression for receiving an alignment key adapted to set an angle of each of said first and second support blocks relative to an overlapping support block.

25. A plurality of concrete blocks as claimed in claim 21, wherein said cast texture has a surface level difference of greater than 4 mm.

26. A plurality of concrete blocks as claimed in claim 25, wherein said surface level difference is greater than 15 mm.

27. A plurality of concrete blocks as claimed in claim 25, wherein each of a plurality of points of said cast texture defines a respective texture angle between 75° and 90°.

28. A plurality of concrete blocks as claimed in claim 25, wherein said cast texture comprises at least one valley each having a respective depth greater than 4 mm.

29. A plurality of concrete blocks as claimed in claim 21, wherein said portion of said surface is an entirety of said surface

30. A plurality of concrete blocks as claimed in claim 21, wherein said portion of said surface is a first portion of said surface and said cast texture is a first cast texture, said surface comprising (1) a second portion with a second cast texture having a natural stone appearance and (2) a third portion without a cast texture having a natural stone appearance, said third portion separating said first portion and said second portion.

31. A concrete block system for use in a structure, said concrete block system comprising:

a support block comprising a first coupling part; and a dry-cast face block made by a dry-casting process and comprising a second coupling part, said first coupling part and said second coupling part enabling said dry-cast face block to be coupled to said support block, said dry-cast face block comprising a surface that is exposed when said dry-cast face block is coupled to said support block and said concrete block system is positioned in the structure, said surface comprising a plurality of portions that are separated from one another and that represent a plurality of natural stone blocks, each of said. portions of said surface having a cast texture with a natural stone appearance that comprises a pattern of cast relief elements formed during the dry-casting process.

32. A concrete block system as claimed in claim 31, wherein said cast texture of each of said portions of said surface has a surface level difference of greater than 4mm.

33. A concrete block system as claimed in claim 31, wherein said cast texture of each of said portions of said surface has a surface level difference of greater than 15mm.

34. A concrete block system as claimed in claim 31, wherein said portions of said surface are separated by at least one portion of said surface representing a false joint.

35. A concrete block system as claimed in claim 31, wherein said first coupling part is one of a protrusion and a groove and said second coupling part is the other one of said protrusion and said groove, said dry-cast face block being adapted to be coupled to said support block via said protrusion fitting into and being surrounded by said groove.

* * * * *